United States Patent [19]

Aono et al.

[11] Patent Number: 4,550,071

[45] Date of Patent: Oct. 29, 1985

[54] HEAT DEVELOPMENT USING ACIDS

[75] Inventors: Toshiaki Aono; Koichi Nakamura, both of Kanagawa, Japan

[73] Assignee: Fuji Photo Film. Co., Ltd., Kanagawa, Japan

[21] Appl. No.: 597,970

[22] Filed: Apr. 9, 1984

[30] Foreign Application Priority Data

Apr. 9, 1983 [JP] Japan ..... 58-62569

[51] Int. Cl.[4] ..... G03C 5/54; G03C 1/40

[52] U.S. Cl. ..... 430/203; 430/216; 430/351; 430/617; 430/619

[58] Field of Search ..... 430/203, 216, 351, 353, 430/617, 619

[56] References Cited

U.S. PATENT DOCUMENTS

| | | | |
|---|---|---|---|
| 3,985,565 | 10/1976 | Gabrielson et al. | 430/203 |
| 4,039,334 | 8/1977 | Ikenque et al. | 430/619 |
| 4,060,420 | 11/1977 | Merkel et al. | 430/619 |
| 4,307,187 | 12/1981 | Ikenove et al. | 430/619 |
| 4,413,050 | 11/1983 | Erf | 430/203 |
| 4,483,914 | 11/1984 | Naito et al. | 430/203 |

OTHER PUBLICATIONS

*Neblette's Handbook of Photography and Reprography* 7th Ed., C1977, Van Nostrand Reinhold Co., N.Y., pp. 324–327.

*Primary Examiner*—Richard L. Schilling
*Attorney, Agent, or Firm*—Sughrue, Mion, Zinn, Macpeak, and Seas

[57] ABSTRACT

An image forming method which comprises (A) exposing to an imagewise pattern of light a light-sensitive material having on a support at least (1) a light-sensitive silver halide, (2) a binder, and (3) a compound which is chemically involved in the reduction of the light-sensitive silver halide to silver under high temperature thereby causing the production or the release of a mobile dye, (B) heating the light-sensitive material in a substantially water-free condition to form the mobile dye with an imagewise distribution subsequently to or simultaneously with the exposure, and (C) transferring the mobile dye into a dye-fixing layer under high temperature and fixing it thereto wherein an acidic component participates chemically in the reaction system for forming the mobile dye after the conclusion of the mobile dye-forming reaction to bring about the desirable effect on lowering the fog density thereof.

13 Claims, No Drawings

HEAT DEVELOPMENT USING ACIDS

FIELD OF THE INVENTION

The present invention relates to a method for forming a dye image by heating under a substantially water-free condition. Specifically, the present invention relates to an image-forming method which utilizes a light-sensitive material having a dye-providing compound which can release a hydrophilic dye by the reaction with a light-sensitive silver halide upon heating under a substantially water-free condition after imagewise exposure. More specifically, the present invention relates to a method for obtaining a dye image by transferring, a dye, which is released by heating, into a dye-fixing layer.

BACKGROUND OF THE INVENTION

Since silver halide-using photography is superior in photographic characteristics, e.g., sensitivity, facility of gradient control, etc., to other photographies such as electrophotography, diazo photography and so on, it has been extensively employed. In recent years, a technique has been developed which enables simple and rapid formation of images by changing the image-forming processing of the silver halide-using photography from a conventional wet process using a developing solution or the like to a dry process by heating or the like.

Heat developable photosensitive materials are well known in the field of the photographic art, and such materials and their processes are described in, for example, *Shashin Kogaku no Kiso,* pp. 553–555, Corona Company (1979); *Eizo Joho,* p. 40 (Apr. 1978); *Nebletts Handbook of Photography and Reprography,* 7th Ed., pp. 32 and 33, Van Nostrand Reinhold Company; U.S. Pat. Nos. 3,152,904, 3,301,678, 3,392,020 and 3,457,075, British Patent Nos. 1,131,108 and 1,167,777, and *Research Disclosure,* pp. 9–15 (RD-17029) (June, 1978).

Many methods for obtaining color images have been proposed. As for the method of forming color images by binding an oxidation product of a developing agent to a coupler, reducing agents of the p-phenylenediamine type and phenolic or active methylene-containing couplers are proposed in U.S. Pat. No. 3,531,286; reducing agents of the p-aminophenol type in U.S. Pat. No. 3,761,270; reducing agents of the sulfonamidophenol type in Belgian Patent No. 802,519 and *Research Disclosure,* pp. 31 and 32 (Sept., 1975); and combinations of reducing agents of the sulfonamidophenol type with 4-equivalent couplers in U.S. Pat. No. 4,021,240.

However, the above-described method suffers from the defect that it provides turbid color images because both reduced silver image and the color image are simultaneously produced in optically exposed areas after heat development. With the intention of solving this problem, a method have been proposed which involves the removal of the silver image by carrying out a liquid treatment and a method which involves the transfer of dyes alone into another layer, e.g., a sheet having an image-receiving layer. However, the latter method has the defect that it is not easy to differentiate between dyes and substances which have not yet undergone the reaction, and to only transfer the dyes.

Another method which comprises the introduction of a nitrogen-containing heterocyclyl group into a dye to form the silver salt thereof and the release of the dye from the silver salt by heat development is described in *Research Disclosure,* pp. 54–58 (RD-16966) (May 1978). This method is unsuitable for common use because it is difficult to inhibit the release of the dye in the unexposed part and, therefore, a clear image cannot be formed.

A further method which comprises formation of positive color images using the light-sensitive silver dye bleach process is described with regard to useful dyes and bleach processes in, e.g., *Research Disclosure,* pp. 30–32 (RD-14433) (Apr., 1976); ibid., pp. 14 and 15 (RD-15227) (Dec., 1976); U.S. Pat. No. 4,235,957, and so on.

However, the above-described method suffers from disadvantages in that it requires an extra step and materials for accelerating the bleach of dyes, specifically the superposition of an activator sheet, the heating thereof and so on. Further, the color images obtained are gradually reduced and bleached by the liberated silver which is also present in the color image upon long-range storage.

A still another method in which color images are formed by taking advantage of leuco dyes is described in, e.g., U.S. Pat. Nos. 3,985,565 and 4,022,617. However, this method has the disadvantage in that it is difficult to stably incorporate the leuco dyes in photographic materials and, consequently, the photographic material is gradually stained upon storage.

In addition, all of the above-described methods suffer from the disadvantages in that they usually require a comparatively long time for the completion of development, and the images obtained have high fog density and low image density.

For the purpose of making improvements in the above methods, methods in which silver halide is utilized and mobile dyes formed with an imagewise distribution are transferred into a dye-fixing layer are disclosed in European Patent Applications (OPI) 76,492 and 79,056 and Japanese Patent Applications (OPI) 149046/83 and 149047/83 (the term "OPI" as used herein refers to a "published unexamined Japanese patent application"). These methods involve the transfer of imagewise formed mobile dyes into a dye-fixing layer under high temperature. However, under such a condition the development of silver halide also proceeds simultaneously. Therefore, the optimum condition allows for a narrow range of choice, and the heating under a strengthened condition causes considerable increase in fog density, generation of turbidity in dye images, and so on.

SUMMARY OF THE INVENTION

A first object of the present invention is to provide a method for forming a dye image by heating under a substantially water-free condition and to solve the problems inherent in light-sensitive materials known to date.

A second object of the present invention is to provide a simple method for obtaining color images which are excellent in processing stability.

A third object of the present invention is to provide a method for forming color images having reduced fog density and high color density.

The above-described objects of the present invention are attained by an image-forming method which comprises (A) imagewise exposing a light-sensitive material having on a support at least (1) a light-sensitive silver halide, (2) a binder, and (3) a compound which is chemically involved in the reduction of the light-sensitive silver halide to silver under high temperature thereby causing the production or the release of a mobile dye; (B) heating the light-sensitive material in a substantially water-free condition to form the mobile dye with an imagewise distribution, subsequently to or simultaneously with the exposure; and (C) transferring the mobile dye into a dye-fixing layer under high temperature and fixing it thereto; wherein an acidic component participates chemically in the reaction system for forming the mobile dye after the conclusion of the mobile dye-forming reaction.

DETAILED DESCRIPTION OF THE INVENTION

The expression "dye image" in the present invention is intended to include both multicolored and monochromatic dye images, and the monochromatic dye image herein includes those made up of a mixture of two or more dyes.

The description "an acidic component participates in the reaction system after the conclusion of the mobile dye-forming reaction" means that the pH value of the layer containing the reaction system in question, which is measured in the condition that water is given to the layer (20 $\mu l/cm^2$ of water is supplied to the surface of the sensitive material to be examined, and a flat-form glass electrode, e.g., GS-165F made by Toa Denpa Co., Ltd. is used for the pH measurement) is lowered by the appearance of an acidic component. Accordingly, the acidic component which can be employed to advantage in the present invention includes those which exhibit acidity when they are present in water, e.g., those known as acidic compounds.

The preferred amount of an acidic component to be present in the present invention should be sufficient to effectively control the pH value measured by the above-described method to a range of below 8.5, preferably from 3 to 7.

The embodiment of the chemical participation of the acidic component in the reaction system after the formation of the mobile dyes can be effected by designing so that the acidic component is absent in the reaction system in the course of forming the mobile dyes, and is present in the reaction system only when the progress of this reaction ceases completely. Specifically, one embodiment (1) comprises the previous addition of an acidic compound to a separate material like a dye-fixing material and contacting the resulting material with the sensitive material after the formation of the mobile dyes.

Another embodiment (2) comprises the incorporation of an acidic compound in the form of its precursor in the sensitive material and release of the acidic compound after the formation of the mobile dyes.

Still another embodiment (3) comprises the addition of an acidic compound, whose diffusibility is controlled so that it participates in the reaction system by the time the mobile dyes are formed, to a layer which, although provided in the sensitive material, is different from the layer containing the above-described reaction system.

In the former embodiment (1), the present invention is achieved by either a relative decrease in the basic component due to the transfer of the basic component contained in the sensitive material into a dye-fixing material which is caused by the presence of the acidic component in the dye-fixing material, or a transfer of the acidic component into the reaction system.

Acidic compounds which can be used in the present invention include both organic and inorganic acids. Suitable examples of organic acids which can be employed include aliphatic saturated monocarboxylic acids, aliphatic unsaturated monocarboxylic acids, aliphatic or aromatic polycarboxylic acids, aromatic carboxylic acids, acids having an acidic hydroxyl group, aliphatic or aromatic sulfonic acids, amino acids and their derivatives, nucleic acids and their derivatives, and heterocyclic compounds and others which have an apparent acid dissociation constant (pKa) of 9 or below. Suitable examples of inorganic acids which can be employed include non-volatile acids.

Specific examples of the acid which can be employed in the present invention include valeric acid, caproic acid, caprylic acid, capric acid, undecylic acid, lauric acid, tridecylic acid, myristic acid, pentadecylic acid, palmitic acid, stearic acid, nonadecanoic acid, arachic acid, behenic acid, lacceric acid, crotonic acid, undecylenic acid, oleic acid, cetoleic acid, sorbic acid, linolic acid, linolenic acid, stearolic acid, propiolic acid, glycolic acid, lactic acid, hydroacrylic acid, oxybutyric acid, glyceric acid, tartronic acid, malic acid, tartaric acid, citric acid, adipic acid, azelaic acid, oxaloacetic acid, glutaric acid, succinic acid, oxalic acid, suberic acid, fumaric acid, maleic acid, malonic acid, anisic acid, benzoic acid, aminobenzoic acid, nitrobenzoic acid, hydroxybenzoic acid, dichlorobenzoic acid, cinnamic acid, naphthoic acid, phenylacetic acid, phthalic acid, mandelic acid, gallic acid, tropic acid, ascorbic acid, reductic acid, reductone, 2,4-dinitrophenol, asparagine, aspartic acid, 4-aminobutyric acid, alanine, alginine, isoleucine, ornithine, glycylglycine, glycine, acetylglycine, glutathione, glutamine, glutamic acid, cystine, cysteine, morin, tyrosine, tryptophan, threonine, histidine, hydroxyproline, proline, homocysteine, methionine, lysine, leucine, nicotinic acid, indole, quinoline, thiazole, nicotinamide, barbituric acid, picolinic acid, pyrazolecarboxylic acid, adenine, adenosine, 2-adenosine phosphate, inosine, uracil, guanine, uric acid, purine, nicotone, ethylenediaminetetraacetic acid, disodium ethylenediaminetetraacetate, nitrilotriacetic acid, 1,2-cyclohexanediamine-N,N,N',N'-tetraacetic acid, benzylaminediacetic acid, benzylethylenediaminetriacetic acid, dihydroxyethyl glycine, diethylenetriaminepentaacetic acid, diaminopropanoltetraacetic acid, ethylenediaminedipropionic acid, glycoletherdiaminotetraacetic acid, hydroxyethyliminodiacetic acid, iminodiacetic acid, nitrilodipropionic acid, benzenesulfonic acid, toluenesulfonic acid, dodecylbenzenesulfonic acid, sulfuric acid, phosphoric acid, pyrophosphoric acid, triphosphoric acid, and acid clay.

Among the foregoing acids, those which can be used as a diffusible acid are acids having a molecular weight of 300 or less and having an (inorganicity/organicity) value of 1 or more (which will be described hereinafter), preferably having a molecular weight of 200 or less and an (inorganicity/organicity) value of 2 or more, or compounds containing such an acid as described above in their individual molecules and satisfying the above-described requirements.

On the other hand, among the foregoing acids, those which can be used as a non-diffusible acid are acids having a molecular weight of 300 or more, or compounds containing such an acid as described above and having a molecular weight of 300 or more, especially polymers containing such an acid as described above in their individual molecules.

Specific examples of the non-diffusible acids which can be preferably employed in the present invention include substances containing an acidic group having a pKa value of 9 or below (or the precursor capable of providing such an acidic group by hydrolysis), especially higher fatty acids such as oleic acid, as described in U.S. Pat. No. 2,983,606; acrylic acid polymers, methacrylic acid polymers, maleic acid polymers and their partial esters or their acid anhydrides, as described in U.S. Pat. No. 3,362,819; copolymers of acrylic acid and acrylates, as described in French Patent No. 2,290,699; and latex type acidic polymers, as described in U.S. Pat. No. 4,139,383 and *Research Disclosure,* No. 16102 (1977).

Besides the above-described acids, those described in U.S. Pat. No. 4,088,493 and Japanese Patent Applications (OPI) Nos. 153739/77, 1023/78, 4540/78, 4541/78 and 4542/78 can be also employed herein.

Examples of the acidic polymer include copolymers of vinyl monomers (such as ethylene, vinyl acetate and vinyl methyl ether) and maleic anhydride; n-butyl partial esters of these copolymers; copolymers of vinylacrylates and acrylic acid; cellulose acetate hydrogenphthalate; and so on.

Among the foregoing acidic compounds, nondiffusible acids and acidic polymers can be incorporated in a sensitive material also. On the other hand, diffusible acidic compounds are favorable for use in a material provided separately, such as a dye-fixing material.

In the most preferred embodiment of the present invention, an acidic compound is added to the dye-fixing material separately from the sensitive material. The acidic compound may be either diffusible or nondiffusible. When a diffusible acidic compound is employed, it is desirable to contact the dye-fixing material with the sensitive material after the formation of mobile dyes.

When a base or a base precursor is incorporated in the dye-fixing material, an acidic compound and/or its precursor should be contained in the layer located nearer to the support than the layer containing the base or the base precursor. The dye-fixing material having such a layer structure is used to advantage where, after or simultaneously with the exposure, a sensitive material is superposed on the dye-fixing material and thereto heat is applied to effect heat development and dye fixation simultaneously.

The present invention has a particularly notable effect on the embodiment that the transfer of dyes is conducted in the presence of a hydrophilic thermal solvent under a high temperature. In this embodiment, the interior of the sensitive material is exceedingly dry and, therefore, it acquires a very high temperature by heating for the transfer of the dyes. Consequently, the foregoing side-effects are produced to a greater extent by the heating for the dye transfer. Such being the case, the present invention produces a more powerful effect on the obviation of such side-effects.

The term "hydrophilic thermal solvent" means a compound which is transformed into liquid by heating (up to 60° C. or above) though it is in a solid state at ordinary temperatures, has an (inorganicity/organicity) value of 1 or above and has a solubility of 1 or more in water at ordinary temperatures. Details of these characters are described in, e.g., *Kagaku no Ryoiki,* Vol. 11, p. 719 (1957). Examples of such compounds are described in Japanese Patent Application 42092/83 (corresponding to U.S. Patent Application Ser. No. 590,592 filed on Mar. 16, 1984 and European Patent Application in the name of Fuji Photo Film Co., Ltd. filed on Mar. 16, 1984.

Since the hydrophilic thermal solvent has a role of assisting the transfer of the hydrophilic dye, it is preferred that the thermal solvent be a compound capable of acting as a solvent for the hydrophilic dye.

In general, it is experimentally known that in a solvent preferred for dissolving an organic compound, the inorganicity/organicity value of the solvent is similar to the inorganicity/organicity value of the organic compound. On the other hand, the inorganicity/organicity value of the non-diffusible 2-equivalent coupler used in this invention is about 1 and the inorganicity/organicity value of the hydrophilic dye released from the non-diffusible 2-equivalent coupler is larger than 1, preferably larger than 1.5, more preferably larger than 2. It is preferred that the hydrophilic thermal solvent can transfer the hydrophilic dye only and cannot transfer the non-diffusible 2-equivalent coupler and hence it is necessary that the inorganicity/organicity value of the hydrophilic thermal solvent is larger than the inorganicity/organicity value of the non-diffusible 2-equivalent coupler. In other words, it is a necessary condition that the inorganicity/organicity value of the hydrophilic thermal solvent is larger than 1, preferably larger than 2.

On the other hand, from the viewpoint of the size of a molecule, it is considered to be preferred that a molecule capable of transferring without obstructing that transfer of a dye exists around the transferring dye. Accordingly, it is preferred that the molecular weight of the hydrophilic thermal solvent in this invention is smaller and is less than about 200, more preferably less than about 100.

In addition, the melting point of the hydrophilic thermal solvent ranges generally from 40° C. to 250° C., preferably from 40° C. to 200° C., and particularly preferably from 40° C. to 150° C.

The hydrophilic thermal solvent is used in the sensitive material and/or dye-fixing material in a coverage corresponding to 5 to 500 wt%, preferably 20 to 200 wt% and more preferably 30 to 150 wt%, of the total coverage of the sensitive material and/or the dye-fixing material other than the coverage of the hydrophilic thermal solvent therein.

In general, the hydrophilic thermal solvent is dissolved in water and then dispersed in a binder. Also, it may be dissolved in alcohols, e.g., methanol, ethanol, etc.

Examples of the hydrophilic thermal solvent include ureas, pyridines, amides, sulfonamides, imides, alcohols, oximes and other heterocyclic compounds.

Specific examples of the hydrophilic thermal solvent which can be preferably used in the present invention are illustrated below.

$$H_2N\overset{\overset{\displaystyle O}{\|}}{C}NH_2 \quad (1)$$

$$H_2N\overset{\overset{\displaystyle O}{\|}}{C}\underset{\underset{\displaystyle H}{|}}{N}CH_3 \quad (2)$$

$$H_2N\overset{\overset{\displaystyle O}{\|}}{C}\underset{\underset{\displaystyle H}{|}}{N}C_2H_5 \quad (3)$$

-continued (4)

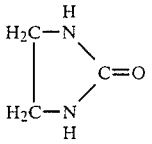

(5)

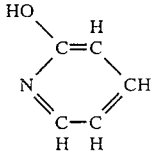

(6)

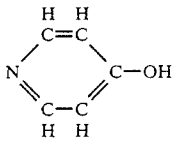

(7)

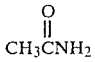

(8)

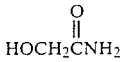

(9)

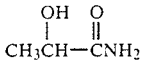

(10) $CH_3SO_2NH_2$

(11) $NH_2SO_2NH_2$

(12) $HOCH_2CH{=}CHCH_2OH$ (13)

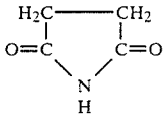

(14)

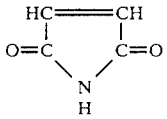

(15)

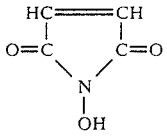

(16)

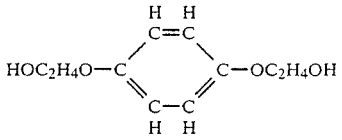

The description "to cause the production of the release of a mobile dye by being chemically involved in the reduction of the light-sensitive silver halide to silver under a high temperature" means, for example, that in the case of a negative silver halide emulsion, the silver halide containing development nucleus produced by optical exposure undergoes the redox reaction together with a reducing agent or a reductive dye-providing compound and thereby, (1) the reducing agent is oxidized to be converted to its oxidant and the resulting oxidant reacts with the dye-providing compound to make the compound produce or release a mobile dye (as described in European Patent Application (OPI) No. 79,056), (2) part of reducing agent is oxidized and the residual reducing agent undergoes the redox reaction together with a dye-providing compound capable of releasing a mobile dye under high temperature and thereby the dye-providing compound is reduced to release the mobile dye [as described in Japanese Patent Application No. 28928/83 (corresponding to U.S. Patent Application Ser. No. 582,655 filed on Feb. 23, 1984 and European Patent Application 84 101 925.0 filed on Feb. 23, 1984)], (3) the reductive dye-providing compound is oxidized and at the time of the oxidation, it releases a mobile dye (as described in European Patent Application (OPI) No. 76,492), or (4) a dye-providing compound capable of releasing the mobile dye at high temperature is oxidized to lose its mobile dye-releasing ability (as described in Japanese Patent Application No. 26008/83 (corresponding to U.S. patent application Ser. No. 580,923 filed on Feb. 16, 1984 and European Patent Application No. 84 101 574.6 filed on Feb. 16, 1984)).

In another case where a positive emulsion is employed in place of a negative emulsion, the above-described reactions take place in the non-exposed area. In reactions (1) and (3), dye images which have positive relations with the silver image are obtained, while in reactions (2) and (4) dye images which have negative relations with the silver image are obtained.

Examples of the compound which can release a mobile dye through reaction (1) are described in European Patent Application (OPI) No. 79,056. These compounds are represented by general formula, C-L-D, wherein D represents a dye moiety for forming an image as described hereinafter, L represents a linkage moiety having such a property that the C-L bond split off upon the reaction of C with the oxidant of a reducing agent, and C is a substrate capable of entering into combination with the oxidant of a reducing agent, e.g., active methylene, active methine, a phenol residue or a naphthol residue. Specific examples thereof include substrates having the following general formulae (A) to (G), respectively:

(A)

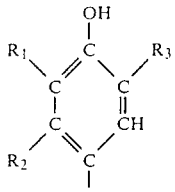

(B)

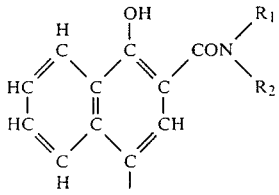

(C)

$R_1COCHCOR_2$

-continued (D)

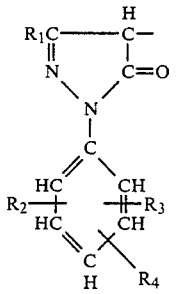

(E)

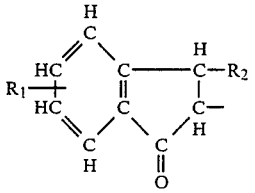

(F)

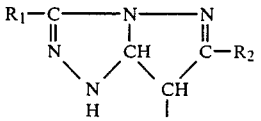

(G)

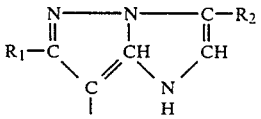

In the foregoing formulae, $R_1$, $R_2$, $R_3$ and $R_4$ each represents a hydrogen atom, an alkyl group, a cycloalkyl group, an aryl group, an alkoxy group, an aralkyl group, an acyl group, an acylamino group, an alkoxyalkyl group, an aryloxyalkyl group, an N-substituted carbamoyl group, an alkylamino group, an arylamino group, a halogen atom, an acyloxy group, an acyloxyalkyl group or a cyano group, and these groups each may be further substituted with a hydroxyl group, a cyano group, a nitro group, an N-substituted sulfamoyl group, a carbamoyl group, an N-substituted carbamoyl group, an acylamino group, an alkylsulfonylamino group, an arylsulfonylamino group, an alkyl group, an aryl group, an alkoxy group, an aryloxy group, an aralkyl group, an acyl group or so on.

It is required that substrate C not only to have the property that it can release the mobile dye by binding to the oxidation product of the reducing agent, but also that it have a ballast group which enables the dye-providing compound itself not to diffuse into other layers. Suitable examples of the ballast group include hydrophobic groups such as alkyl, alkoxyalkyl, aryloxyalkyl and the like. A preferred number of carbon atoms contained in the ballast group is 6 or above, and that in substrate C is 12 or above.

Examples of the compound which can form a mobile dye in reaction (1) include the couplers described in Japanese Patent Application (OPI) Nos. 149046/83 and 149047/83, that is, couplers which have in their elimination part such a moiety as to inhibit the diffusion of the coupler itself, e.g., a ballast group having a sufficient large size or a polymeric moiety obtained by polymerization of vinyl monomers, and in their mother nuclei part do not have any groups as to inhibit the diffusion of the dye formed.

Examples of the compound which can be employed in reaction (2) include those undergoing the intramolecular nucleophilic reaction and more specifically those described in U.S. Pat. No. 4,139,379.

Examples of the compound which can be employed in reaction (4) include the reductants of the compounds described in the above-described U.S. Patent.

Examples of the compound which can be employed in reaction (3) include the reductive dye-providing compounds capable of releasing hydrophilic diffusible dyes which are described in European Patent Application (OPI) No. 76,492.

The dye releasing redox compound which releases a hydrophilic diffusible dye used in the present invention is represented by the following general formula (I):

$$Ra—SO_2—D \quad (I)$$

wherein Ra represents a reducing group capable of being oxidized by the silver halide; and D represents an image forming dye portion containing a hydrophilic group.

Preferably the reducing group Ra in the dye releasing redox compound $Ra—SO_2—D$ has an oxidation-reduction potential to a saturated calomel electrode of 1.2 V or less measuring the polarographic half wave potential using acetonitrile as a solvent and sodium perchlorate as a base electrolyte. Preferred examples of the reducing group Ra include those represented by the following general formulae (II) to (IX).

(II)

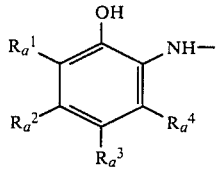

(III)

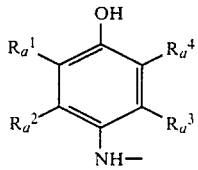

(IV)

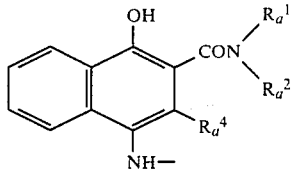

(V)

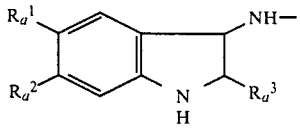

(VI)

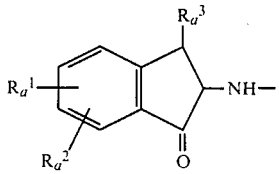

-continued (VII)

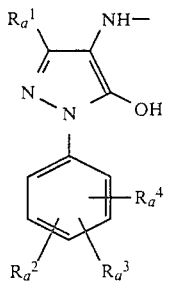

(VIII)

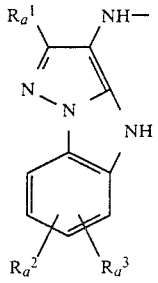

(IX)

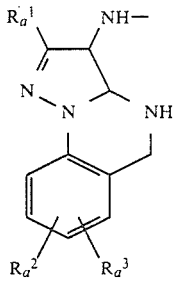

wherein $R_a^1$, $R_a^2$, $R_a^3$ and $R_a^4$ each represents a hydrogen atom or a substituent selected from an alkyl group, a cycloalkyl group, an aryl group, an alkoxy group, an aryloxy group, an aralkyl group, an acyl group, an acylamino group, an alkylsulfonylamino group, an arylsulfonylamino group, an aryloxyalkyl group, an alkoxyalkyl group, an N-substituted carbamoyl group, an N-substituted sulfamoyl group, a halogen atom, an alkylthio group or an arylthio group. The alkyl moiety and the aryl moiety in the above described substituents may be further substituted with an alkoxy group, a halogen atom, a hydroxy group, a cyano group, an acyl group, an acylamino group, a substituted carbamoyl group, a substituted sulfamoyl group, an alkylsulfonylamino group, an arylsulfonylamino group, a substituted ureido group or a carboalkoxy group. Furthermore, the hydroxy group and the amino group included in the reducing group represented by Ra may be protected by a protective group capable of reproducing the hydroxy group and the amino group by the action of a nucleophilic agent.

In more preferred embodiments of the present invention, the reducing group Ra is represented by the following general formula (X).

(X)

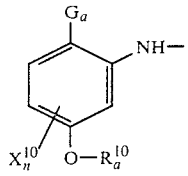

wherein Ga represents a hydroxy group or a group giving a hydroxy group upon hydrolysis; $R_a^{10}$ represents an alkyl group or an aromatic group; n represents an integer of 1 to 3; $X^{10}$ represents an electron donating substituent when n is 1 or substituents, which may be the same or different, one of the substituents being an electron donating group and the second or second and third substituents being selected from an electron donating group or a halogen atom when n is 2 or 3, respectively; wherein $X^{10}$ groups may form a condensed ring with each other or with $OR_a^{10}$, and the total number of the carbon atoms included in $R_a^{10}$ and $X^{10}$ is not less than 8.

Of the reducing groups represented by the general formula (X), more preferred reducing groups Ra are represented by the following general formulae (Xa) and (Xb):

(Xa)

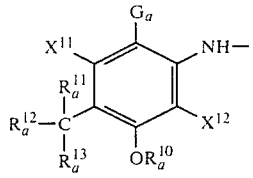

wherein Ga represents a hydroxy group or a group giving a hydroxy group upon hydrolysis; $R_a^{11}$ and $R_a^{12}$, which may be the same or different, each represents an alkyl group or $R_a^{11}$ and $R_a^{12}$ may be bonded to each other to form a ring; $R_a^{13}$ represents a hydrogen atom or an alkyl group; $R_a^{10}$ represents an alkyl group or an aromatic group; $X^{11}$ and $X^{12}$, which may be the same or different, each represents a hydrogen atom, an alkyl group, an alkoxy group, a halogen atom, an acylamino group or an alkylthio group; and $R_a^{10}$ and $X^{12}$ or $R_a^{10}$ and $R_a^{13}$ may be bonded to each other to form a ring, (Xb)

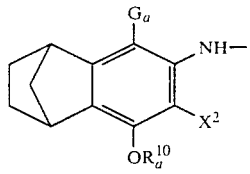

wherein Ga represents a hydroxy group or a group giving a hydroxy group upon hydrolysis; $R_a^{10}$ represents an alkyl group or an aromatic group; $X^2$ represents a hydrogen atom, an alkyl group, an alkoxy group, a halogen atom, an acylamino group or an alkylthio group; and $X^2$ and $R_a^{10}$ may be bonded to each other to form a ring.

Specific examples of the reducing groups represented by the above described general formulae (X), (Xa) and (Xb) are described in U.S. Pat. No. 4,055,428, Japanese Patent Application (OPI) Nos. 12642/81 and 16130/81, respectively.

In other more preferred embodiments of the present invention, the reducing group Ra is represented by the following general formula (XI).

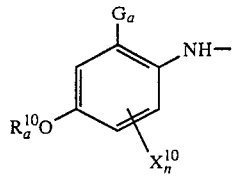

(XI)

wherein Ga, $X^{10}$, $R_a^{10}$ and n each has the same meaning as Ga, $X^{10}$, $R_a^{10}$ and n defined in the general formula (X).

Of the reducing groups represented by the general formula (XI), more preferred reducing groups Ra are represented by the following general formulae (XIa), (XIb) and (XIc)

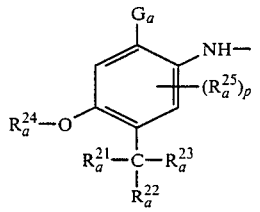

(XIa)

wherein Ga represents a hydroxy group or a group giving a hydroxy group upon hydrolysis; $R_a^{21}$ and $R_a^{22}$, which may be the same or different, each represents an alkyl group or an aromatic group, and $R_a^{21}$ and $R_a^{22}$ may be bonded to each other to form a ring; $R_a^{23}$ represents a hydrogen atom, an alkyl group or an aromatic group; $R_a^{24}$ represents an alkyl group or an aromatic group; $R_a^{25}$ represents an alkyl group, an alkoxy group, an alkylthio group, an arylthio group, a halogen atom or an acylamino group; p is 0, 1 or 2; $R_a^{24}$ and $R_a^{25}$ may be bonded to each other to form a condensed ring; $R_a^{21}$ and $R_a^{24}$ may be bonded to each other to form a condensed ring; $R_a^{21}$ and $R_a^{25}$ may be bonded to each other to form a condensed ring; and the total number of the carbon atoms included in $R_a^{21}$, $R_a^{22}$, $R_a^{23}$, $R_a^{24}$ and $(R_a^{25})_p$ is more than 7.

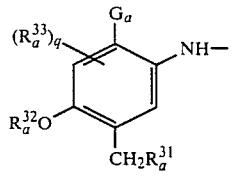

(XIb)

wherein Ga represents a hydroxy group or a group giving a hydroxy group upon hydrolysis; $R_a^{31}$ represents an alkyl group or an aromatic group; $R_a^{32}$ represents an alkyl group or an aromatic group; $R_a^{33}$ represents an alkyl group, an alkoxy group, an alkylthio group, an arylthio group, a halogen atom or an acylamino group; q is 0, 1 or 2; $R_a^{32}$ and $R_a^{33}$ may be bonded to each other to form a condensed ring; $R_a^{31}$ and $R_a^{32}$ may be bonded to each other to form a condensed ring; $R_a^{31}$ and $R_a^{33}$ may be bonded to each other to form a condensed ring; and the total number of the carbon atoms included in $R_a^{31}$, $R_a^{32}$ and $(R_a^{33})_q$ is more than 7.

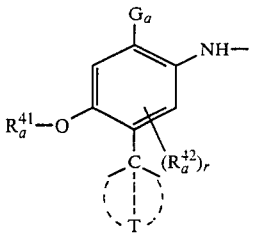

(XIc)

wherein Ga represents a hydroxy group or a group giving a hydroxy group upon hydrolysis; $R_a^{41}$ represents an alkyl group or an aromatic group; $R_a^{42}$ represents an alkyl group, an alkoxy group, an alkylthio group, an arylthio group, a halogen atom or an acylamino group; r is 0, 1 or 2; the group of

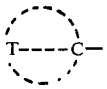

represents a group in which 2 to 4 saturated hydrocarbon rings are condensed, the carbon atom

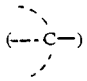

in the condensed ring which is connected to the phenol nucleus (or a precursor thereof), represents a tertiary carbon atom which composes one of the pivot of the condensed ring, a part of the carbon atoms (excluding the above described tertiary carbon atom) in the hydrocarbon ring may be substituted for oxygen atom(s), the hydrocarbon ring may have a substituent, and an aromatic ring may be further condensed to the hydrocarbon ring; $R_a^{41}$ or $R_a^{42}$ and the group of

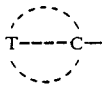

may be bonded to each other to form a condensed ring; and the total number of the carbon atoms included in $R_a^{41}$, $(R_a^{42})_r$ and the group of

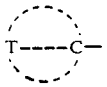

is not less than 7.

Specific examples of the reducing groups represented by the above described general formulae (XI), (XIa), (XIb) and (XIc) are described in Japanese Patent Application (OPI) Nos. 16131/81, 650/82 and 4043/82.

The essential part in the groups represented by the general formulae (III) and (IV) is a para(sulfonyl-)aminophenol part. Specific examples of these reducing groups are described in U.S. Pat. Nos. 3,928,312 and 4,076,529, U.S. Published Patent Application B Ser. No. 351,673, U.S. Pat. Nos. 4,135,929 and 4,258,120. These groups are also effective for the reducing group Ra according to the present invention.

In still other more preferred embodiments of the present invention, the reducing group Ra is represented by the following general formula (XII).

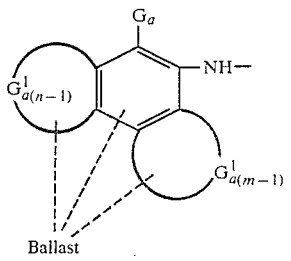

(XII)

wherein Ballast represents a diffusion-resistant group; Ga represents a hydroxy group or a precursor of a hydroxy group; $G_a{}^1$ represents an aromatic ring directly condensed to the benzene nucleus to form a naphthalene nucleus; and n and m are dissimilar positive integers of 1 to 2.

Specific examples of the reducing groups represented by the above described general formula (XII) are described in U.S. Pat. No. 4,053,312.

The reducing groups represented by the above described general formulae (V), (VII), (VIII) and (IX) are characterized by containing a heterocyclic ring. Specific examples of the groups are described in U.S. Pat. No. 4,198,235, Japanese Patent Application (OPI) No. 46730/78 and U.S. Pat. No. 4,273,855.

Specific examples of the reducing groups represented by the general formula (VI) are described in U.S. Pat. No. 4,149,892.

Characteristics required for the reducing group Ra are as follows.

1. It is rapidly oxidized by the silver halide to effectively release a diffusible dye for image formation by the function of the dye releasing activator.

2. The reducing group Ra has an extensive hydrophobic property, because it is necessary for the dye releasing redox compound to be diffusion-resistant in a hydrophilic or hydrophobic binder and that only the released dye has diffusibility.

3. It has excellent stability to heat and to the dye releasing activator and does not release the image forming dye until it is oxidized; and 4. It is easily synthesized.

In the following, specific examples of preferred reducing groups Ra which satisfy the above described requirements are shown. In the examples, NH— represents the bond to the dye portion.

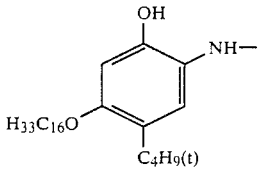

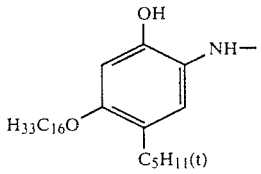

-continued

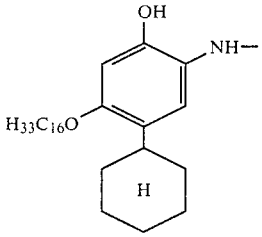

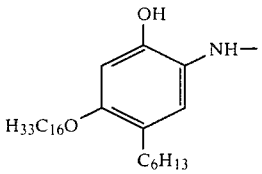

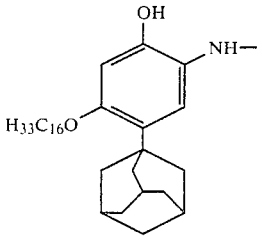

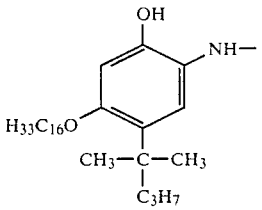

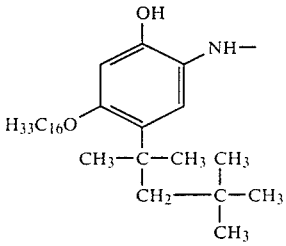

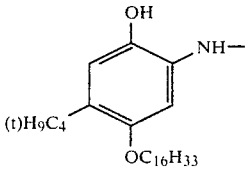

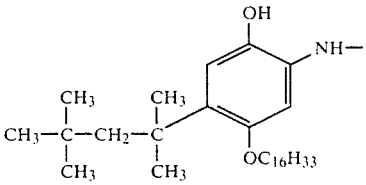

-continued

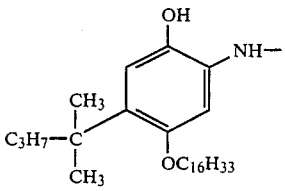

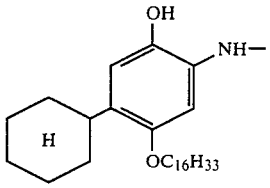

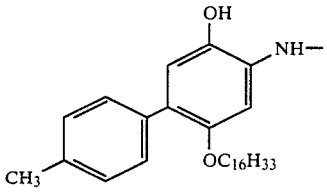

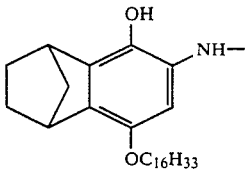

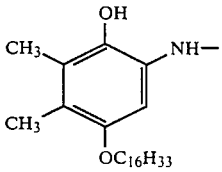

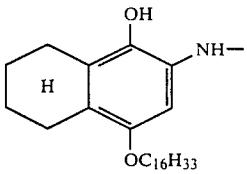

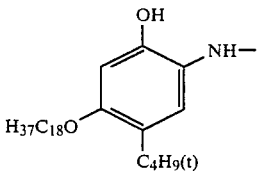

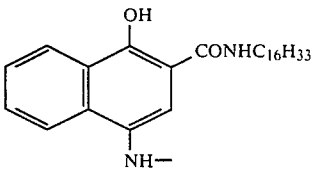

-continued

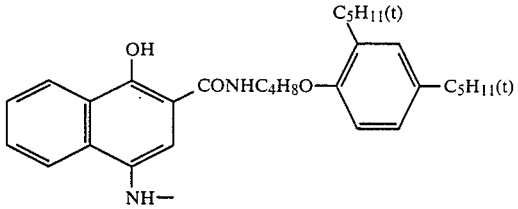

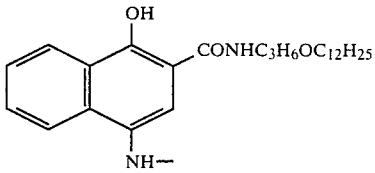

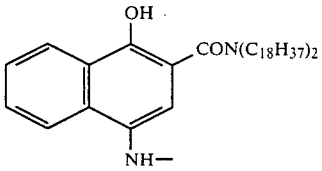

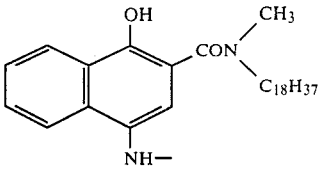

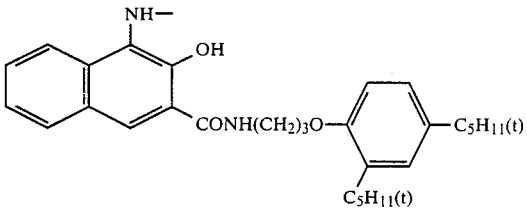

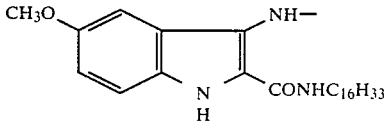

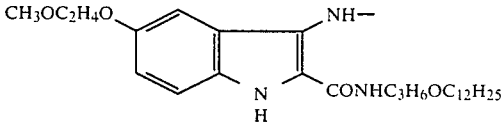

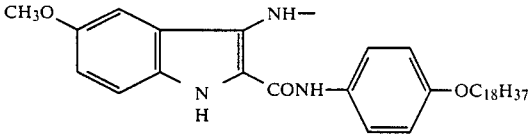

Examples of dyes which can be used for image forming dye include azo dyes, azomethine dyes, anthraquinone dyes, naphthoquinone dyes, styryl dyes, nitro dyes, quinoline dyes, carbonyl dyes and phthalocyanine dyes, etc. Representative examples of them are set forth below and are classified by hue. Further, these dyes can be used in a form temporarily shifted to shorter wavelength region which is capable of regeneration during the development processing.

Yellow:
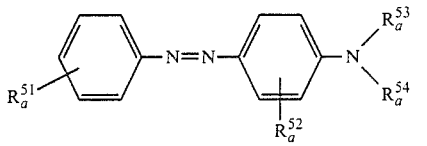
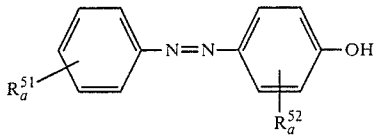
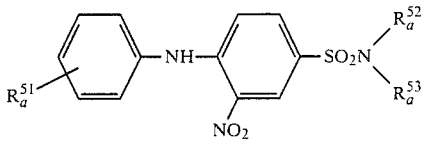
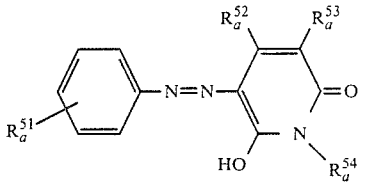
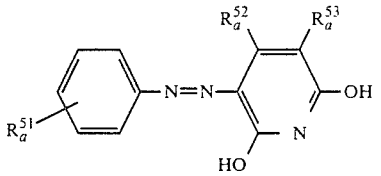
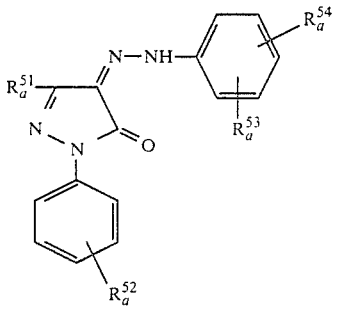
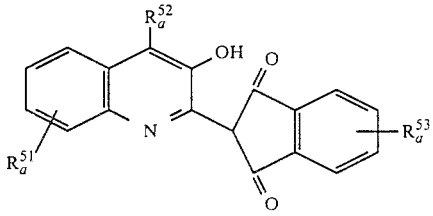
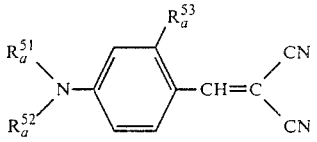
-continued
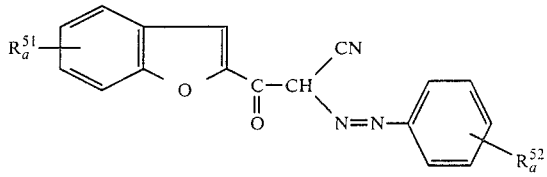
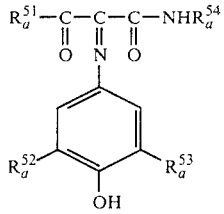
Magenta:
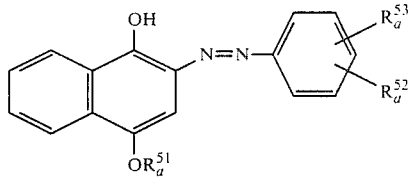
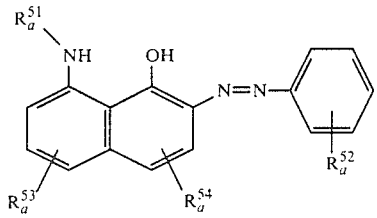
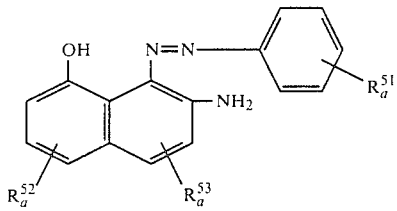
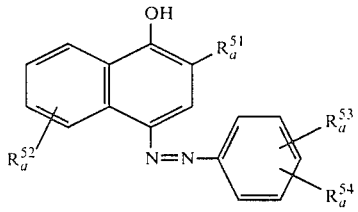

-continued
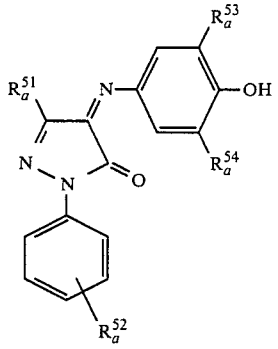
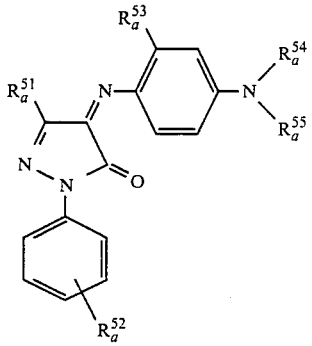
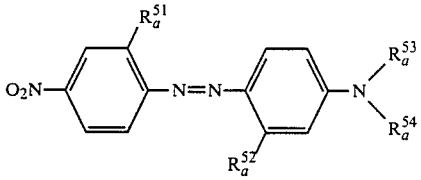
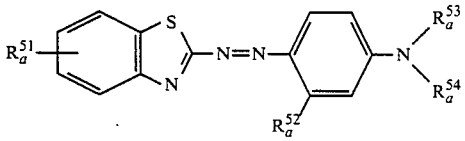
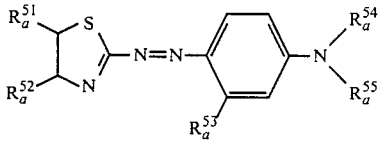
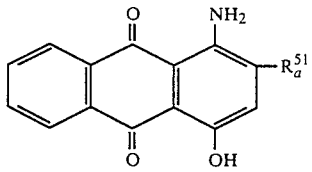
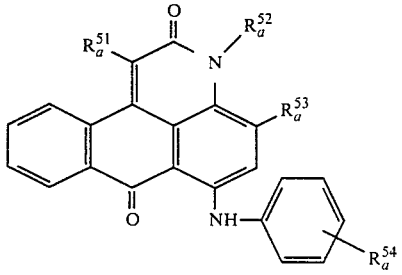
-continued
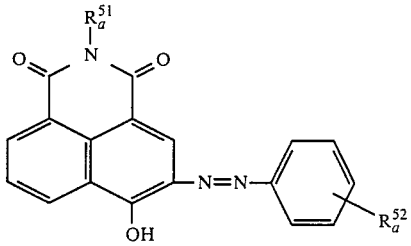
Cyan:
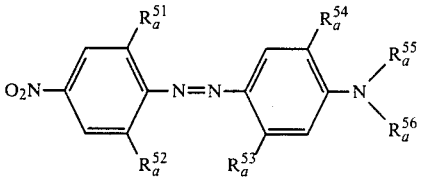
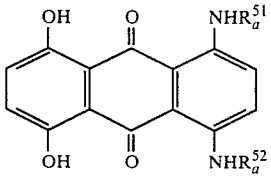
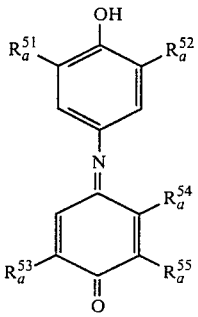
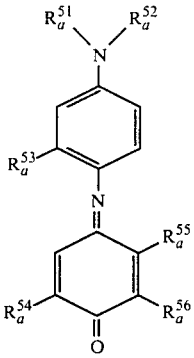
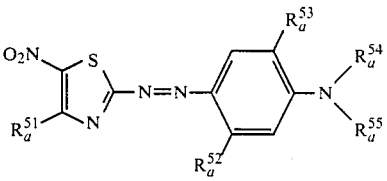

-continued

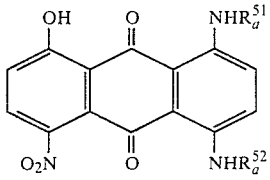

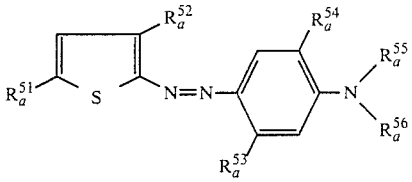

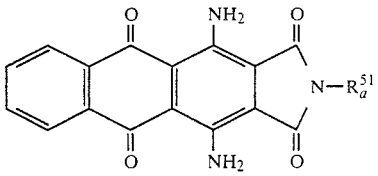

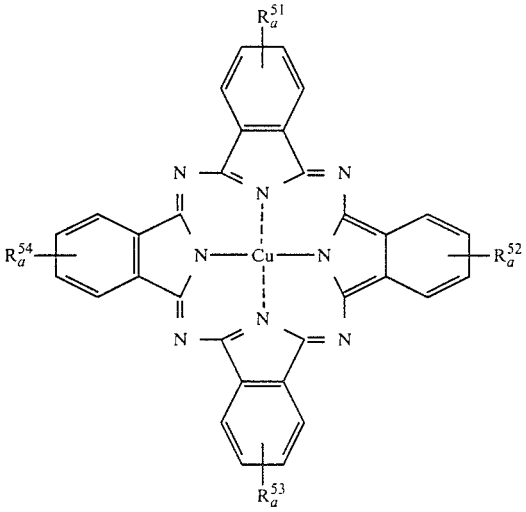

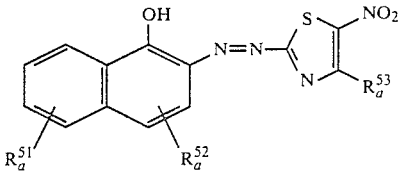

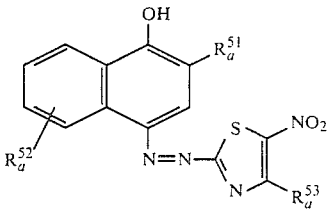

-continued

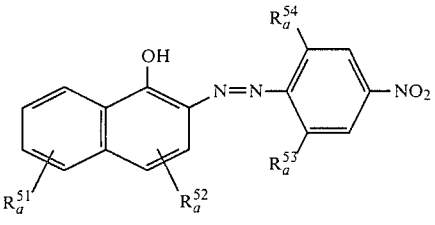

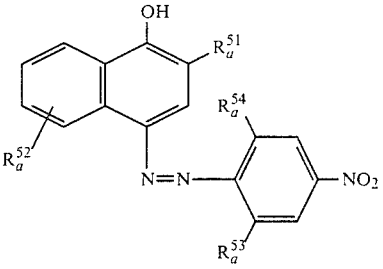

In the above described formulae, $R_a^{51}$ to $R_a^{56}$ each represents a hydrogen atom or a substituent selected from an alkyl group, a cycloalkyl group, an aralkyl group, an alkoxy group, an aryloxy group, an aryl group, an acylamino group, an acyl group, a cyano group, a hydroxyl group, an alkylsulfonylamino group, an arylsulfonylamino group, an alkylsulfonyl group, a hydroxyalkyl group, a cyanoalkyl group, an alkoxycarbonylalkyl group, an alkoxyalkyl group, an aryloxyalkyl group, a nitro group, a halogen atom, a sulfamoyl group, an N-substituted sulfamoyl group, a carbamoyl group, an N-substituted carbamoyl group, an acyloxyalkyl group, an amino group, a substituted amino group, an alkylthio group or an arylthio group. The alkyl moiety and the aryl moiety in the above described substituents may be further substituted with a halogen atom, a hydroxy group, a cyano group, an acyl group, an acylamino group, an alkoxy group, a carbamoyl group, a substituted carbamoyl group, a sulfamoyl group, a substituted sulfamoyl group, a carboxy group, an alkylsulfonylamino group, an arylsulfonylamino group or a ureido group.

Examples of the hydrophilic groups include a hydroxy group, a carboxy group, a sulfo group, a phosphoric acid group, an imido group, a hydroxamic acid group, a quaternary ammonium group, a carbamoyl group, a substituted carbamoyl group, a sulfamoyl group, a substituted sulfamoyl group, a sulfamoylamino group, a substituted sulfamoylamino group, a ureido group, a substituted ureido group, an alkoxy group, a hydroxyalkoxy group, an alkoxyalkoxy group, etc.

In the present invention, those in which the hydrophilic property thereof is increased by dissociation of a proton under a basic condition are particularly preferred. Examples of these groups include a phenolic hydroxy group, a carboxy group, a sulfo group, a phosphoric acid group, an imido group, a hydroxamic acid group, a (substituted) sulfamoyl group, a (substituted) sulfamoylamino group, etc.

Characteristics required for the image forming dye are as follows.

1. It has a hue suitable for color reproduction.
2. It has a large molecular extinction coefficient.
3. It is fast to light and heat and stable for the dye releasing activator and other additives included in the system; and 4. It is easily synthesized.
Specific examples of preferred image forming dyes which satisfy the above described requirements are described in the following. In the examples, $H_2NSO_2$— represents a group necessary to bond to the reducing group.
Yellow
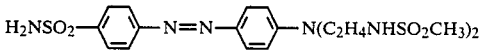
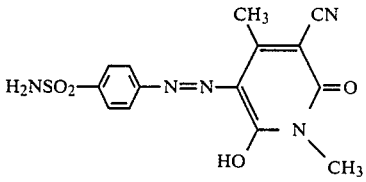
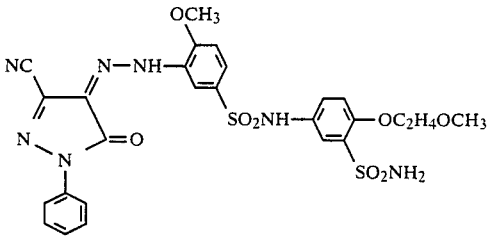
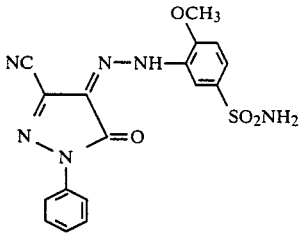
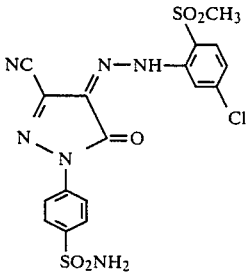
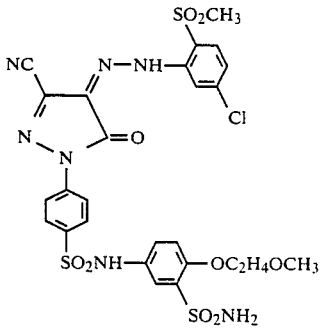
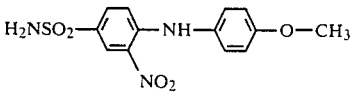
-continued
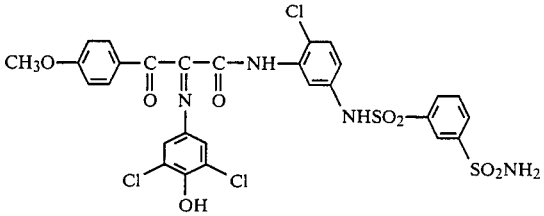
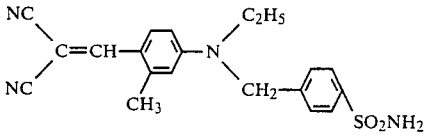
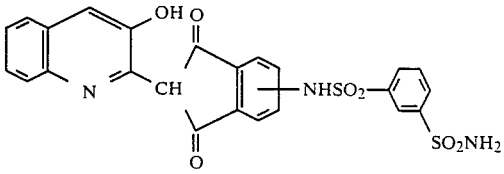
Magenta
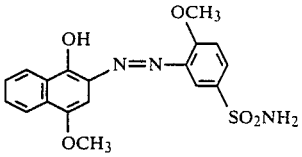
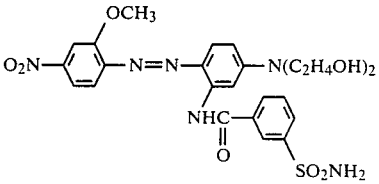
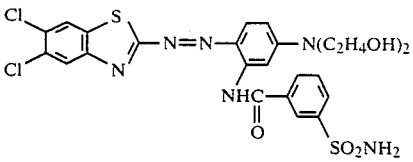
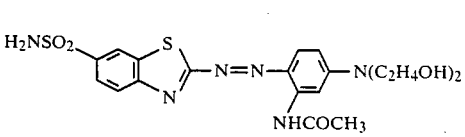
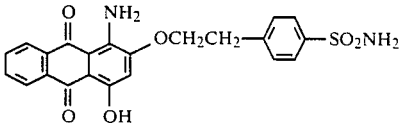

-continued
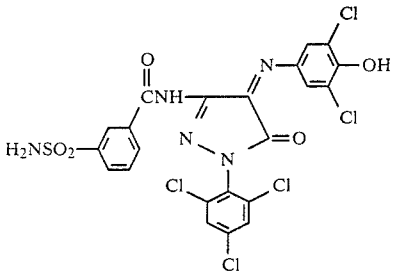
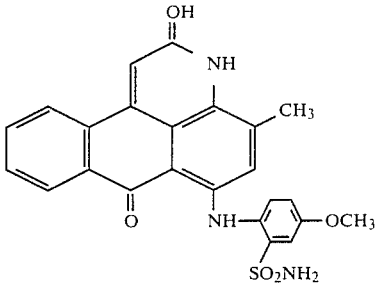
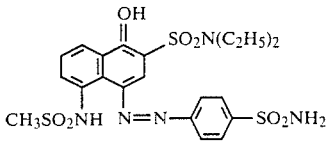
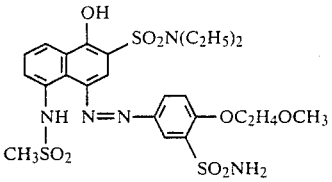
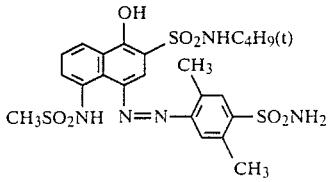
Cyan
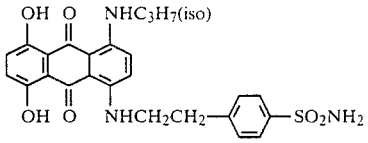
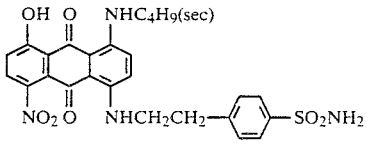
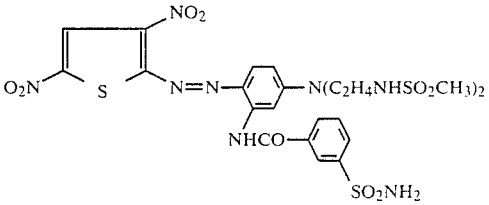
-continued
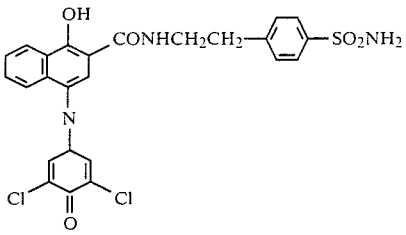
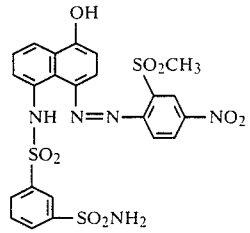
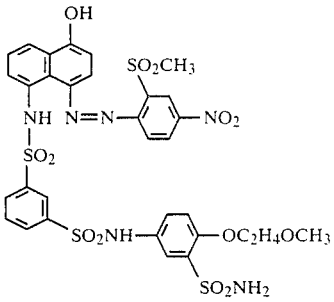
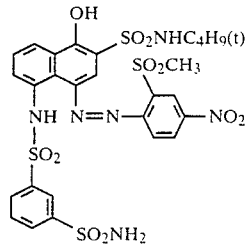
Practical examples of the dye-providing compounds are those described in European Patent Application (OPI) No. 76,492. Typical examples of the dye-providing compounds being used in the Examples hereinafter are illustrated below.
Dye-Providing Compound (7):
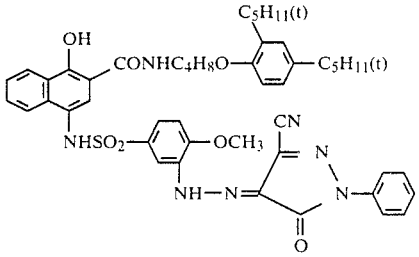
Dye-Providing Compound (10):

-continued

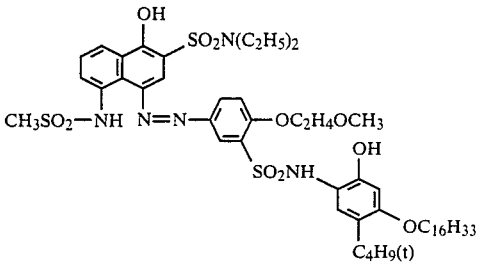

Dye-Providing Compound (21):

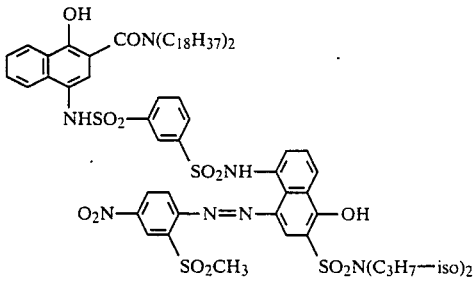

Dye-Providing Compound (42):

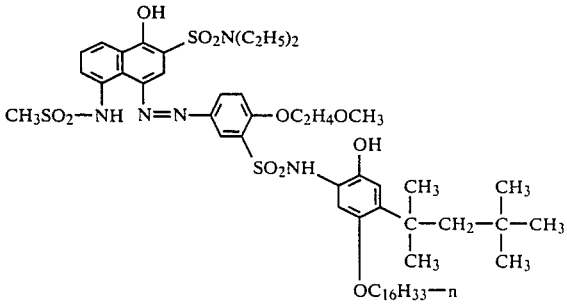

Dye-Providing Compound (68):

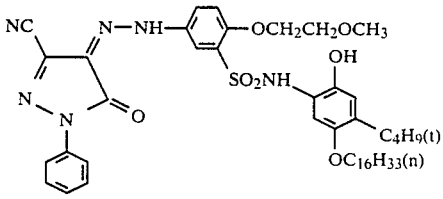

Dye-Providing Compound BB:

-continued

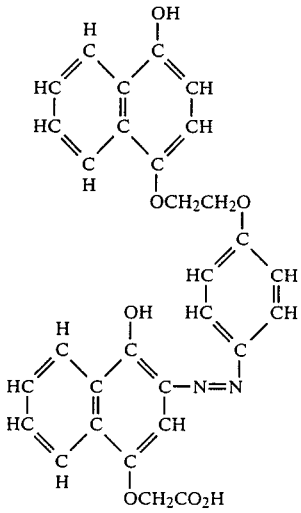

As the dye releasing redox compounds used in the present invention, the compounds as described, for example, in U.S. Pat. No. 4,055,428, Japanese Patent Application (OPI) Nos. 12642/81, 16130/81, 16131/81, 650/82 and 4043/82, U.S. Pat. Nos. 3,928,312 and 4,076,529, U.S. Published Patent Application B Ser. No. 351,673, U.S. Pat. Nos. 4,135,929 and 4,198,235, Japanese Patent Application (OPI) No. 46730/78, U.S. Pat. Nos. 4,273,855, 4,149,892, 4,142,891 and 4,258,120, etc., are also effective in addition to the above described specific examples.

Further, the dye releasing redox compounds which release a yellow dye as described, for example, in U.S. Pat. Nos. 4,013,633, 4,156,609, 4,148,641, 4,165,987, 4,148,643, 4,183,755, 4,246,414, 4,268,625 and 4,245,028, Japanese Patent Application (OPI) Nos. 71072/81, 25737/81, 138744/80, 134849/80, 106727/77, 114930/76, etc., can be effectively used in the present invention.

The dye releasing redox compounds which release a magenta dye as described, for example, in U.S. Pat. Nos. 3,954,476, 3,932,380, 3,931,144, 3,932,381, 4,268,624 and 4,255,509, Japanese Patent Application (OPI) Nos. 73057/81, 71060/81, 134850/80, 40402/80, 36804/80, 23628/78, 106727/77, 33142/80 and 53329/80, etc., can be effectively used in the present invention.

The dye releasing redox compounds which release a cyan dye as described, for example, in U.S. Pat. Nos. 3,929,760, 4,013,635, 3,942,987, 4,273,708, 4,148,642, 4,183,754, 4,147,544, 4,165,238, 4,246,414 and 4,268,625, Japanese Patent Application (OPI) Nos. 71061/81, 47823/78, 8827/77 and 143323/78, etc., can be effectively used in the present invention.

Two or more of the dye releasing redox compounds can be used together. In these cases, two or more dye releasing redox compounds may be used together in order to represent the same hue or in order to represent black color.

The dye releasing redox compounds are suitably used in a range from 10 mg/m$^2$ to 15 g/m$^2$ and preferably in a range from 20 mg/m$^2$ to 10 g/m$^2$ in a total.

In the present invention, a dye-providing compound releases or produces a mobile dye with an imagewise pattern by being chemically involved in optically exposed silver halide. This reaction is characterized by its reaction condition, i.e., it takes place under high temperatures and in a substantially water-free condition. Herein, the expression "high temperatures" is intended to include temperatures not lower than 80° C., and the expression "dried condition free substantially from water" means that the reaction system is in equilibrium with moisture in the air and has no water supply from the outside thereof. Details of such a condition are described in *The Theory of the Photographic Process*, 4th Ed. (edited by T. H. James), page 374, Macmillan, N.Y. The occurrence of the above-described reaction with sufficiently high reactivity even under the dried condition free substantially from water can be confirmed by the fact that the reactivity of the sample was not lowered even by the drying treatment under a reduced pressure of $10^{-3}$ mmHg over a period of 1 hour.

The reaction of the present invention can proceed with high efficiency in the presence of an organic silver salt type oxidizing agent and thereby the image dye is produced with high density. Therefore, a particularly preferable embodiment of the present invention involves the presence of an organic silver salt type oxidizing agent in the above-described reaction system.

The dye releasing redox compound used in the present invention can be introduced into a layer of the light-sensitive material by known methods such as a method as described in U.S. Pat. No. 2,322,027. In this case, an organic solvent having a high boiling point or an organic solvent having a low boiling point as described below can be used. For example, the dye releasing redox compound is dispersed in a hydrophilic colloid after dissolved in an organic solvent having a high boiling point, for example, a phthalic acid alkyl ester (for example, dibutyl phthalate, dioctyl phthalate, etc.), a phosphoric acid ester (for example, diphenyl phosphate, triphenyl phosphate, tricresyl phosphate, dioctylbutyl phosphate, etc.), a citric acid ester (for example, tributyl acetylcitrate, etc.), a benzoic acid ester (for example, octyl benzoate, etc.), an alkylamide (for example, diethyl laurylamide, etc.), an aliphatic acid ester (for example, dibutoxyethyl succinate, dioctyl azelate, etc.), a trimesic acid ester (for example, tributyl trimesate, etc.), etc., or an organic solvent having a boiling point of about 30° C. to 160° C., for example, a lower alkyl acetate such as ethyl acetate, butyl acetate, etc., ethyl propionate, secondary butyl alcohol, methyl isobutyl ketone, $\beta$-ethoxyethyl acetate, methyl cellusolve acetate, cyclohexanone, etc. The above described organic solvents having a high boiling point and organic solvents having a low boiling point may be used as a mixture thereof.

Further, it is possible to use a dispersion method using a polymer as described in Japanese Patent Publication No. 39853/76 and Japanese Patent Application (OPI) No. 59943/76. Moreover, various surface active agents can be used when the dye releasing redox compound is dispersed in a hydrophilic colloid. For this purpose, the surface active agents illustrated in other part of the specification can be used.

An amount of the organic solvent having a high boiling point used in the present invention is 10 g per g of the dye releasing redox compound used or less and preferably 5 g per g or less.

In the present invention, if necessary, the so-called auxiliary developing agent can be used even when the dye releasing redox compound is used. The auxiliary developing agent in this case is a compound which is oxidized upon the silver halide to form its oxidized product having an ability to oxidize the reducing group Ra in the dye releasing redox compound.

Examples of useful auxiliary developing agents include hydroquinone, alkyl substituted hydroquinones such as tertiary butylhydroquinone, 2,5-dimethylhydroquinone, etc., catechols, pyrogallols, halogen substituted hydroquinones such as chlorohydroquinone, dichlorohydroquinone, etc., alkoxy substituted hydroquinones such as methoxyhydroquinone, and polyhydroxybenzene derivatives such as methyl hydroxynaphthalene, etc. Further, methyl gallate, ascorbic acid, ascorbic acid derivatives, hydroxylamines such as N,N-di(2-ethoxyethyl)hydroxylamine, etc., pyrazolidones such as 1-phenyl-3-pyrazolidone, 4-methyl-4-hydroxymethyl-1-phenyl-3-pyrazolidone, etc., reductones and hydroxy tetronic acids are useful.

The auxiliary developing agent can be used in an amount of a fixed range. A suitable range is 0.0005 time by mol to 20 times by mol based on silver. A particularly suitable range is 0.001 time by mol to 4 times by mol.

The reducing agents used in the present invention include the following compounds.

Hydroquinone compounds (for example, hydroquinone, 2,5-dichlorohydroquinone, 2-chlorohydroquinone, etc.), aminophenol compounds (for example, 4-aminophenol, N-methylaminophenol, 3-methyl-4-aminophenol, 3,5-dibromoaminophenol, etc.), catechol compounds (for example, catechol, 4-cyclohexylcatechol, 3-methoxycatechol, 4-(N-octadecylamino)catechol, etc.), phenylenediamine compounds (for example, N,N-diethyl-p-phenylenediamine, 3-methyl-N,N-diethyl-p-phenylenediamine, 3-methoxy-N-ethyl-N-ethoxy-p-phenylenediamine, N,N,N',N'-tetramethyl-p-phenylenediamine, etc.).

More preferred reducing agents include the following compounds.

3-Pyrazolidone compounds (for example, 1-phenyl-3-pyrazolidone, 1-phenyl-4,4-dimethyl-3-pyrazolidone, 4-hydroxymethyl-4-methyl-1-phenyl-3-pyrazolidone, 1-m-tolyl-3-pyrazolidone, 1-p-tolyl-3-pyrazolidone, 1-phenyl-4-methyl-3-pyrazolidone, 1-phenyl-5-methyl-3-pyrazolidone, 1-phenyl-4,4-bis(hydromethyl)-3-pyrazolidone, 1,4-dimethyl-3-pyrazolidone, 4-methyl-3-pyrazolidone, 4,4-dimethyl-3-pyrazolidone, 1-(3-chlorophenyl)-4-methyl-3-pyrazolidone, 1-(4-chlorophenyl)-4-methyl-3-pyrazolidone, 1-(4-tolyl)-4-methyl-3-pyrazolidone, 1-(2-tolyl)-4-methyl-3-pyrazolidone, 1-(4-tolyl)-3-pyrazolidone, 1-(3-tolyl)-3-pyrazolidone, 1-(3-tolyl)-4,4-dimethyl-3-pyrazolidone, 1-(2-trifluoroethyl)-4,4-dimethyl-3-pyrazolidone, 5-methyl-3-pyrazolidone).

Various combinations of developing agents as described in U.S. Pat. No. 3,039,869 can also be used.

In the present invention, an amount of the reducing agent added is from 0.01 mol to 20 mols per mol of silver and more preferably from 0.1 mol to 10 mols per mol of silver.

The silver halide used in the present invention includes silver chloride, silver chlorobromide, silver chloroiodide, silver bromide, silver iodobromide, silver chloroiodobromide and silver iodide, etc.

In the embodiment of the present invention in which the organic silver salt oxidizing agent is not used together with but the silver halide is used alone, particularly preferred silver halide is silver halide partially containing a silver iodide crystal in its particle. That is, the silver halide the X-ray diffraction pattern of which shows that of pure silver iodide is particularly preferred.

In photographic materials a silver halide containing two or more kinds of halogen atoms can be used. Such a silver halide yields a completely mixed crystal in a conventional silver halide emulsion. For example, the particle of silver iodobromide shows X-ray diffraction pattern at a position corresponding to the mixed ratio of silver iodide crystal and silver bromide crystal but not at a position corresponding to pure silver iodide crystal and pure silver bromide crystal separately.

Particularly preferred examples of silver halide used in the present invention include silver chloroiodide, silver iodobromide, and silver chloroiodobromide each containing silver iodide crystal in its particle and showing X-ray diffraction pattern of silver iodide crystal.

The process for preparing those silver halides is explained taking the case of silver iodobromide. That is, the silver iodobromide is prepared by first adding silver nitrate solution to potassium bromide solution to form silver bromide particles and then adding potassium iodide to the mixture.

Two or more kinds of silver halides in which a particle size and/or a halogen composition are different each other may be used in mixture.

An average particle size of the silver halide used in the present invention is preferably from 0.001 μm to 10 μm and more preferably from 0.001 μm to 5 μm.

The silver halide used in the present invention may be used as is. However, it may be chemically sensitized with a chemical sensitizing agent such as compounds of sulfur, selenium or tellurium, etc., or compounds of gold, platinum, palladium, rhodium or iridium, etc., a reducing agent such as tin halide, etc., or a combination thereof. The details thereof are described in T. H. James, *The Theory of the Photographic Process,* the Fourth Edition, Chapter 5, pages 149 to 169.

In the particularly preferred embodiment of the present invention, an organic silver salt oxidizing agent is used together. The organic silver salt oxidizing agent is a silver salt which forms a silver image by reacting with the above described image-forming substance or a reducing agent coexisting, if necessary, with the image-forming substance, when it is heated to a temperature of above 80° C. and, preferably, above 100° C. in the presence of exposed silver halide. By coexisting the organic silver salt oxidizing agent, the light-sensitive material which provides higher color density can be obtained.

The silver halide used in this case is not always necessary to have the characteristic in that the silver halide contains pure silver iodide crystal in the case of using the silver halide alone. Any silver halide which is known in the art can be used.

Examples of such organic silver salt oxidizing agents include the following compounds.

A silver salt of an organic compound having a carboxy group. Typical examples thereof include a silver salt of an aliphatic carboxylic acid and a silver salt of an aromatic carboxylic acid.

Examples of the silver salts of aliphatic carboxylic acids include silver behenate, silver stearate, silver oleate, silver laurate, silver caprate, silver myristate, silver palmitate, silver maleate, silver fumarate, silver tartarate, silver furoate, silver linolate, silver oleate, silver adipate, silver sebacate, silver succinate, silver acetate, silver butyrate and silver camphorate, etc. These silver salts which are substituted with a halogen atom or a hydroxy group are also effectively used.

Examples of the silver salts of aromatic carboxylic acid and other carboxyl group containing compounds include silver benzoate, a silver substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc., silver gallate, silver tannate, silver phthalate, silver terephthalate, silver salicylate, silver phenylacetate, silver pyromellitate, a silver salt of 3-carboxymethyl-4-methyl-4-thiazoline-2-thione, etc., as described in U.S. Pat. No. 3,785,830, and a silver salt of an aliphatic carboxylic acid containing a thioether group as described in U.S. Pat. No. 3,330,663, etc.

In addition, a silver salt of a compound containing a mercapto group or a thione group and a derivative thereof can be used.

Examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-mercaptobenzothiazole, a silver salt of 2-(S-ethylglycolamido)benzothiazole, a silver salt of thioglycolic acid such as a silver salt of an S-alkyl thioglycol acetic acid (wherein the alkyl group has from 12 to 22 carbon atoms) as described in Japanese Patent Application (OPI) No. 28221/73, a silver salt of dithiocarboxylic acid such as a silver salt of dithioacetic acid, a silver salt of thioamide, a silver salt of 5-carboxyl-1-methyl-2-phenyl-4-thiopyridine, a silver salt of mercaptotriazine, a silver salt of 2-mercaptobenzoxazole, a silver salt of mercaptooxadiazole, a silver salt as described in U.S. Pat. No. 4,123,274, for example, a silver salt of 1,2,4-mercaptotriazole derivative such as a silver salt of 3-amino-5-benzylthio-1,2,4-triazole, a silver salt of thione compound such as a silver salt of 3-(2-carboxyethyl)-4-methyl-4-thiazoline-2-thione as described in U.S. Pat. No. 3,301,678, and the like.

Further, a silver salt of a compound containing an imino group can be used. Examples of these compounds include a silver salt of benzotriazole and a derivative thereof as described in Japanese Patent Publication Nos. 30270/69 and 18416/70, for example, a silver salt of benzotriazole, a silver salt of alkyl substituted benzotriazole such as a silver salt of methylbenzotriazole, etc., a silver salt of a halogen substituted benzotriazole such as a silver salt of 5-chlorobenzotriazole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220,709, a silver salt of carbazole, a silver salt of saccharin, a silver salt of imidazole and an imidazole derivative, and the like.

Moreover, a silver salt as described in *Research Disclosure,* Vol. 170, No. 17029 (June, 1978) and an organic metal salt such as copper stearate, etc., are the organic metal salt oxidizing agent capable of being used in the present invention.

Two or more organic silver salt oxidizing agents can be used together.

The mechanism of the heat-development process under heating in the present invention is not entirely clear, but it is believed to be as follows.

When the light-sensitive material is exposed to light, a latent image is formed in a light-sensitive silver halide. This phenomenon is described in T. H. James, *The Theory of the Photographic Process,* Third Edition, pages 105 to 148.

When the light-sensitive material is heated, the reducing agent, the dye releasing redox compound, in the case of the present invention reduces the silver halide or the silver halide and the organic silver salt oxidizing agent in the presence of the latent image nuclei as a catalyst to form silver, while it is oxidized itself. The oxidized product of the dye releasing redox compound is cleaved to release a dye.

Methods of preparing these silver halide and organic silver salt oxidizing agents and manners of blending them are described in *Research Disclosure*, No. 17029, Japanese Patent Application (OPI) Nos. 32928/75 and 42529/76, U.S. Pat. No. 3,700,458, and Japanese Patent Application (OPI) Nos. 13224/74 and 17216/75.

A suitable coating amount of the light-sensitive silver halide and the organic silver salt oxidizing agent employed in the present invention is in a total of from 50 $mg/m^2$ to 10 $g/m^2$ calculated as an amount of silver.

The light-sensitive silver halide and the organic silver salt oxidizing agent used in the present invention are prepared in the binder as described below. Further, the dye releasing redox compound is dispersed in the binder described below.

The binder which can be used in the present invention can be employed individually or in a combination thereof. A hydrophilic binder can be used as the binder according to the present invention. The typical hydrophilic binder is a transparent or translucent hydrophilic colloid, examples of which include a natural substance, for example, protein such as gelatin, a gelatin derivative, a cellulose derivative, etc., a polysaccharide such as starch, gum arabic, etc., and a synthetic polymer, for example, a water-soluble polyvinyl compound such as polyvinyl pyrrolidone, acrylamide polymer, etc. Another example of the synthetic polymer compound is a dispersed vinyl compound in a latex form which is used for the purpose of increasing dimensional stability of a photographic material.

The silver halide used in the present invention can be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful. Any conventionally utilized nucleus for cyanine dyes, such as basic heterocyclic nuclei, is applicable to these dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a bezindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei may also be substituted.

To merocyanine dyes and complex merocyanine dyes, as nuclei having a ketomethylene structure, 5- or 6-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, etc., may also be applicable.

Useful sensitizing dyes include those described in German Patent No. 929,080, U.S. Pat. Nos. 2,231,658, 2,493,748, 2,503,776, 2,519,001, 2,912,329, 3,656,959, 3,672,897, 3,694,217, 4,025,349 and 4,046,572, British Patent No. 1,242,588, Japanese Patent Publication Nos. 14030/69 and 24844/77, etc.

These sensitizing dyes can be employed individually, and can also be employed in combination thereof. A combination of sensitizing dyes is often used, particularly for the purpose of supersensitization.

Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Patents Nos. 1,344,281 and 1,507,803, Japanese Patent Publication Nos. 4936/68 and 12375/78, Japanese Patent Application (OPI) Nos. 110618/77 and 109925/77, etc.

The sensitizing dyes may be present in the emulsion together with dyes which themselves do not give rise to spectrally sensitizing effects but exhibit a supersensitizing effect or materials which do not substantially absorb visible light but exhibit a supersensitizing effect. For example, aminostilbene compounds substituted with a nitrogen-containing heterocyclic group (e.g., those described in U.S. Pat. Nos. 2,933,390 and 3,635,721), aromatic organic acid-formaldehyde condensates (e.g., those described in U.S. Pat. No. 3,743,510), cadmium salts, azaindene compounds, etc., can be present. The combinations described in U.S. Pat. Nos. 3,615,613, 3,615,641, 3,617,295 and 3,635,721 are particularly useful.

A support used in the present invention is that which can endure at the processing temperature. As an ordinary support, not only glass, paper, metal or analogues thereof may be used, but also an acetyl cellulose film, a cellulose ester film, a polyvinyl acetal film, a polystyrene film, a polycarbonate film, a polyethylene terephthalate film, and a film related thereof or a plastic material may be used. The polyesters described in U.S. Pat. Nos. 3,634,089 and 3,725,070 are preferably used.

In the present invention, various kinds of dye releasing activator can be used. The dye releasing activator means a substance which accelerates the oxidation-reduction reaction between the light-sensitive silver halide and/or the organic silver salt oxidizing agent and dye releasing redox compound or accelerates release of a dye by means of its nucleophilic action to the oxidized dye releasing redox compound in the dye releasing reaction subsequently occurred, and a base and a base precursor can be used. It is particularly advantageous to use these dye releasing activators in order to accelerate the reactions in the present invention.

Examples of preferred bases are amines which include trialkylamines, hydroxylamines, aliphatic polyamines, N-alkyl substituted aromatic amines, N-hydroxyalkyl substituted aromatic amines and bis[p-(dialkylamino)phenyl]methanes. Further, there are betaine tetramethylammonium iodide and diaminobutane dihydrochloride as described in U.S. Pat. No. 2,410,644, and urea and organic compounds including amino acids such as 6-aminocaproic acid as described in U.S. Pat. No. 3,506,444. The base precursor is a substance which releases a basic component by heating. Examples of typical base precursors are described in British Pat. No. 998,949. A preferred base precursor is a salt of a carboxylic acid and an organic base, and examples of the suitable carboxylic acids include trichloroacetic acid and trifluoroacetic acid and examples of the suitable bases include guanidine, piperidine, morpholine, p-toluidine and 2-picoline, etc. Guanidine trichloroacetate as described in U.S. Pat. No. 3,220,846 is particularly preferred. Further, aldonic amides as described in Japanese Patent Application (OPI) No. 22625/75 are preferably used because they decompose at a high temperature to form bases.

These dye releasing activators can be used in an amount of a broad range. A useful range is up to 50% by weight based on the amount of a dry layer coated of the light-sensitive material. A range of 0.01% by weight to 40% by weight is more preferred.

It is advantageous to use a compound represented by the general formula described below in the heat-developable color photographic material in order to accelerate development and accelerate release of a dye.

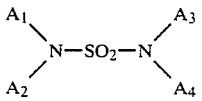

(A)

wherein $A_1$, $A_2$, $A_3$ and $A_4$, which may be the same or different, each represents a hydrogen atom or a substituent selected from an alkyl group, a substituted alkyl group, a cycloalkyl group, an aralkyl group, an aryl group, a substituted aryl group and a heterocyclic group; and $A_1$ and $A_2$ or $A_3$ and $A_4$ may combine with each other to form a ring.

Specific examples of the compounds include $H_2NSO_2NH_2$, $H_2NSO_2N(CH_3)_2$, $H_2NSO_2N(C_2H_5)_2$, $H_2NSO_2NHCH_3$, $H_2NSO_2N(C_2H_4OH)_2$, $CH_3NHSO_2NHCH_3$,

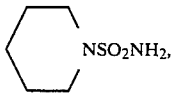

etc.

The above described compound can be used in an amount of broad range. A useful range is up to 20% by weight based on the amount of a dry layer coated of the light-sensitive material. A range of 0.1% by weight to 15% by weight is more preferred.

It is advantageous to use a water releasing compound in the present invention in order to accelerate the dye releasing reaction.

The water releasing compound means a compound which releases water by decomposition during heat development. These compounds are particularly known in the field of printing of fabrics, and $NH_4Fe(SO_4)_2.12H_2O$, etc., as described in Japanese Patent Application (OPI) No. 88386/75 are useful.

Further, in the present invention, it is possible to use a compound which activates development simultaneously while stabilizing the image. Particularly, it is preferred to use isothiuroniums including 2-hydroxyethylisothiuronium trichloroacetate as described in U.S. Pat. No. 3,301,678, bisisothiuroniums including 1,8-(3,6-dioxaoctane)-bis(isothiuronium trifluoroacetate), etc., as described in U.S. Pat. No. 3,669,670, thiol compounds as described in German Patent Application (OLS) No. 2,162,714, thiazolium compounds such as 2-amino-2-thiazolium trichloroacetate, 2-amino-5-bromoethyl-2-thiazolium trichloroacetate, etc., as described in U.S. Pat. No. 4,012,260, compounds having α-sulfonylacetate as an acid part such as bis(2-amino-2-thiazolium)methylenebis(sulfonylacetate), 2-amino-2-thiazolium phenylsulfonylacetate, etc., as described in U.S. Pat. No. 4,060,420, and compounds having 2-carboxycarboxamide as an acid part as described in U.S. Pat. No. 4,088,496.

In the present invention, it is possible to use a thermal solvent. The term "thermal solvent" means a non-hydrolyzable organic material which is solid at an ambient temperature but melts together with other components at a temperature of heat treatment or below. Preferred examples of thermal solvents include compounds which can act as a solvent for the developing agent and compounds having a high dielectric constant which accelerate physical development of silver salts. Examples of preferred thermal solvents include polyglycols as described in U.S. Pat. No. 3,347,675, for example, polyethylene glycol having an average molecular weight of 1,500 to 20,000, derivatives of polyethylene oxide such as polyethylene oxide oleic acid ester, etc., beeswax, monostearin, compounds having a high dielectric constant which have an —$SO_2$— or —CO— group such as acetamide, succinimide, ethylcarbamate, urea, methylsulfonamide or ethylene carbonate, polar substances as described in U.S. Pat. No. 3,667,959, lactone of 4-hydroxybutanoic acid, methylsulfinylmethane, tetrahydrothiophene-1,1-dioxide, and 1,10-decanediol, methyl anisate and biphenyl suberate as described in *Research Disclosure,* pages 26 to 28 (Dec., 1976), etc.

In the present invention, though it is not so necessary to further incorporate substances or dyes for preventing irradiation or halation in the light-sensitive material, because the light-sensitive material is colored by the dye releasing redox compound, it is possible to add filter dyes or light absorbing materials, etc., as described in Japanese Patent Publication No. 3692/73 and U.S. Pat. Nos. 3,253,921, 2,527,583 and 2,956,879, etc., in order to further improve sharpness. It is preferred that these dyes have a thermal bleaching property. For example, dyes as described in U.S. Pat. Nos. 3,769,019, 3,745,009 and 3,615,432 are preferred.

The light-sensitive material used in the present invention may contain, if necessary, various additives known for the heat-developable light-sensitive materials and may have a layer other than the light-sensitive layer, for example, an antistatic layer, an electrically conductive layer, a protective layer, an intermediate layer, an anti-halation layer, a strippable layer, etc.

The photographic emulsion layer and other hydrophilic colloid layers in the light-sensitive material of the present invention may contain various surface active agents for various purposes, for example, as coating aids or for prevention of electrically charging, improvement of lubricating property, emulsification, prevention of adhesion, improvement of photographic properties (for example, acceleration of development, rendering hard tone or sensitization), etc.

For example, it is possible to use nonionic surface active agents such as saponin (steroid), alkylene oxide derivatives (for example, polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkylamine or amides, polyethylene oxide adducts of silicone, etc.), glycidol derivatives (for example, alkenylsuccinic acid polyglycerides, alkylphenol polyglycerides, etc.), polyhydric alcohol aliphatic acid esters or saccharide alkyl esters, etc.; anionic surface active agents containing acid groups such as a carboxy group, a sulfo group, a phospho group, a sulfate group, a phosphate group, etc., such as alkylcarboxylic acid salts, alkylsulfonic acid salts, alkylbenzenesulfonic acid salts, alkylnaphthalenesulfonic acid salts, alkyl sulfuric acid esters, alkylphosphoric acid esters, N-acyl-N-alkyltaurines, sulfosuccinic acid esters, sulfoalkyl polyoxyethylene alkylphenyl ethers, polyoxyethylene alkylphosphoric acid esters, etc.; ampholytic surface active agents such as amino acids, aminoalkylsulfonic acids, aminoalkylsulfuric acid esters or phosphoric acid esters, alkylbetaines, amine oxides, etc.; and cationic surface active agents such as alkylamine salts, aliphatic or aromatic quaternary ammonium salts, heterocyclic quaternary ammonium salts such as pyridinium salts, imidazolium salts, etc., aliphatic or heterocyclic phosphonium salts, aliphatic or heterocyclic sulfonium salts, etc.

Of the above-described surface active agents, polyethylene glycol type nonionic surface active agents having a recurring unit of ethylene oxide in their molecules may be preferably incorporated into the light-sensitive material. It is particularly preferred that the molecule contains 5 or more of the recurring units of ethylene oxide.

The nonionic surface active agents capable of satisfying the above described conditions are well known as to their structures, properties and methods of synthesis. These nonionic surface active agents are widely used even outside this field. Representative references relating to these agents include: *Surfactant Science Series,* Vol. 1, Nonionic Surfactants (edited by Martin J. Schick, Marcel Dekker Inc., 1967), and *Surface Active Ethylene Oxide Adducts,* (edited by Schoufeldt N. Pergamon Press, 1969). Among the nonionic surface active agents described in the above mentioned references, those capable of satisfying the above described conditions are preferably employed in connection with the present invention.

The nonionic surface active agents can be used individually or as a mixture of two or more of them.

The polyethylene glycol type nonionic surface active agents can be used in an amount of less than 100% by weight, preferably less than 50% by weight, based on a hydrophilic binder.

The light-sensitive material of the present invention may contain a cationic compound containing a pyridinium salt. Examples of the cationic compounds containing a pyridinium group used are described in PSA Journal Section B 36 (1953), U.S. Pat. Nos. 2,648,604 and 3,671,247, Japanese Patent Publication Nos. 30074/69 and 9503/69, etc.

In the photographic light-sensitive material and the dye fixing material of the present invention, the photographic emulsion layer and other binder layers may contain inorganic or organic hardeners. It is possible to use chromium salts (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloylhexahydro-s-triazine, 1,3-vinylsulfonyl-2-propanol, etc.), active halogen compounds (2,4-dichloro-6-hydroxy-s-triazine, etc.), mucohalogenic acids (mucochloric acid, mucophenoxychloric acid, etc.), etc., which are used individually or as a combination thereof.

Examples of various additives include those described in *Research Disclosure,* Vol. 170, No. 17029 (June, 1978), for example, plasticizers, dyes for improving sharpness, antihalation dyes, sensitizing dyes, matting agents, fluorescent whitening agents and fading preventing agent, etc.

The protective layer, the intermediate layer, the subbing layer, the back layer and other layers can be produced by preparing each coating solution and applying to a support by various coating methods such as a dip coating method, an air-knife coating method, a curtain coating method or a hopper coating method as described in U.S. Pat. No. 2,681,294 and drying in the same manner as used in preparing the heat-developable light-sensitive layer of the present invention, by which the light-sensitive material is obtained.

If necessary, two or more layers may be applied at the same time by the method as described in U.S. Pat. No. 2,761,791 and British Pat. No. 837,095.

Various means of exposure can be used in the present invention. Latent images are obtained by image-wise exposure by radiant rays including visible rays. Generally, light sources used for conventional color prints can be used, examples of which include tungsten lamps, mercury lamps, halogen lamps such as iodine lamps, xenon lamps, laser light sources, CRT light sources, fluorescent tubes and light-emitting diodes, etc.

The original may be line drawings or photographs having gradation. Further, it is possible to take a photograph of a portrait or landscape by means of a camera. Printing from the original may be carried out by contact printing by superposing the original on the material or may be carried out by reflection printing or enlargement printing.

It is also possible to carry out the printing of images photographed by a videocamera or image informations sent from a television broadcasting station by displaying on a cathode ray tube (CRT) or a fiber optical tube (FOT) and focusing the resulting image on the heat-developable photographic material by contacting therewith or by means of a lens.

Recently, light-emitting diode (LED) systems which have been greatly improved have begun to be utilized as an exposure means or display means for various apparatus and devices. It is difficult to produce an LED which effectively emits blue light. In this case, in order to reproduce the color image, three kinds of LEDs consisting of those emitting each green light, red light and infrared light are used. The light-sensitive material to be sensitized by these lights is produced so as to release a yellow dye, a magenta dye and a cyan dye, respectively.

The light-sensitive material is produced using a construction such that the green-sensitive part (layer) contains a yellow dye releasing redox compound, the red-sensitive part (layer) contains a magenta dye releasing redox compound and the infrared-sensitive part (layer) contains a cyan dye releasing redox compound. Other combinations can be utilized, if necessary.

In addition to the above described methods of contacting or projecting the original, there is a method of exposure wherein the original illuminated by a light source is stored in a memory of a reading computer by means of a light-receiving element such as a phototube or a charge coupling device (CCD). The information is, if necessary, subjected to processing, the so-called image treatment, and resulting image information is reproduced on CRT which can be utilized as an image-like light source or lights are emitted by three kinds of LED according to the prcoessed information.

After the heat-developable color photographic material is exposed to light, the resulting latent image can be developed by heating the whole material to a suitably elevated temperature, for example, about 80° C. to about 250° C. for about 0.5 second to about 300 seconds. A higher temperature or lower temperature can be utilized to prolong or shorten the heating time, if it is within the above described temperature range. Particularly, a temperature range of about 110° C. to about 160° C. is useful.

As the heating means, a simple heat plate, iron, heat roller, heat generator utilizing carbon or titanium white, etc., or analogues thereof may be used.

In the present invention, a specific method for forming a color image by heat development comprises transfer of a hydrophilic mobile dye. For this purpose, the heat-developable color photographic material of the present invention is composed of a support having thereon a light-sensitive layer (I) containing at least silver halide, an organic silver salt oxidizing agent, a dye releasing redox compound which is also a reducing agent for the organic silver salt oxiding agent and a binder, and a dye fixing layer (II) capable of receiving the hydrophilic diffusible dye formed in the light-sensitive layer (I).

The above described light-sensitive layer (I) and the dye fixing layer (II) may be formed on the same support, or they may be formed on different supports, respectively. The dye fixing layer (II) can be stripped off the light-sensitive layer (I). For example, after the heat-developable color photographic material is exposed imagewise to light, it is developed by heating uniformly and thereafter the dye fixing layer (II) or the light-sensitive layer (I) is peeled apart. Also, when a light-sensitive material having the light-sensitive layer coated on a support and a fixing material having the dye fixing layer (II) coated on a support are separately formed, after the light-sensitive material is exposed imagewise to light and uniformly heated, the mobile dye can be transferred on the dye fixing layer (II) by superposing the fixing material on the light-sensitive material.

Further, there is a method wherein only the light-sensitive layer (I) is exposed imagewise to light and then heated uniformly by superposing the dye fixing layer (II) on the light-sensitive layer (I).

The dye fixing layer (II) can contain, for example, a dye mordant in order to fix the dye. In the present invention, various mordants can be used, and polymer mordants are particularly preferred. In addition to the mordants, the dye fixing layer may contain the bases, base precursors and thermal solvents. In particular, it is particularly preferred to incorporate the bases or base precursors into the dye fixing layer (II) in the cases wherein the light-sensitive layer (I) and the dye fixing layer are formed on different supports.

Polymer mordants used in the present invention are polymers containing secondary and tertiary amino groups, polymers containing nitrogen-containing heterocyclic moieties, polymers having quaternary cation groups thereof, having a molecular weight of from 5,000 to 200,000, and particularly from 10,000 to 50,000.

For example, there are illustrated vinylpyridine polymers and vinylpyridinium cation polymers as disclosed in U.S. Pat. Nos. 2,548,564, 2,484,430, 3,148,061 and 3,756,814, etc., polymer mordants capable of cross-linking with gelatin as disclosed in U.S. Pat. Nos. 3,625,694, 3,859,096 and 4,128,538, British Pat. No. 1,277,453, etc., aqueous sol type mordants as disclosed in U.S. Pat. Nos. 3,958,995, 2,721,852 and 2,798,063, Japanese Patent Application (OPI) Nos. 115228/79, 145529/79 and 126027/79, etc., water-insoluble mordants as disclosed in U.S. Pat. No. 3,898,088, etc., reactive mordants capable of forming covalent bonds with dyes used as disclosed in U.S. Pat. No. 4,168,976 (Japanese Patent Application (OPI) No. 137333/79), etc., and mordants disclosed in U.S. Pat. Nos. 3,709,690, 3,788,855, 3,642,482, 3,488,706, 3,557,066, 3,271,147 and 3,271,148, Japanese Patent Application (OPI) Nos. 71332/75, 30328/78, 155528/77, 125/78 and 1024/78, etc.

In addition, mordants disclosed in U.S. Pat. Nos. 2,675,316 and 2,882,156 can be used.

Of these mordants, for example, mordants capable of cross-linking with a matrix such as gelatin, water-insoluble mordants, and aqueous sol (or latex dispersion) type mordants are preferably used.

Particularly preferably polymer mordants are described below.

(1) Polymers having quaternary ammonium groups and groups capable of forming covalent bonds with gelatin (for example, aldehydo groups, chloroalkanoyl groups, chloroalkyl groups, vinylsulfonyl groups, pyridiniumpropionyl groups, vinylcarbonyl groups, alkylsulfonoxy groups, etc.), such as

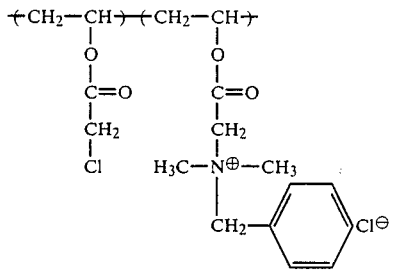

(2) Reaction products between a copolymer comprising a repeating unit of a monomer represented by the general formula described below with a repeating unit of another ethylenically unsaturated monomer and a cross-linking agent (for example, bisalkanesulfonate, bisarenesulfonate, etc.):

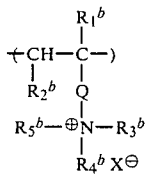

wherein $R_1^b$ represents H or an alkyl group, $R_2^b$ represents H, an alkyl group or an aryl group, Q represents a divalent group, $R_3^b$, $R_4^b$ and $R_5^b$ each represents an alkyl group, an aryl group or at least two of $R_3^b$ to $R_5^b$ are bonded together to form a hetero ring, and X represents an anion. The above described alkyl groups and aryl groups may be substituted.

(3) Polymers represented by the following general formula

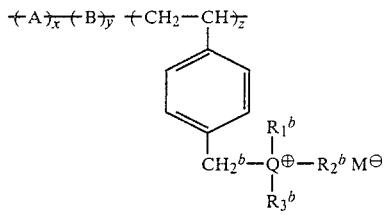

wherein x is from about 0.25 mol% to about 5 mol%, y is from about 0 mol% to about 90 mol%, z is from about 10 mol% to about 99 mol%, A represents a monomer having at least two ethylenically unsaturated bonds, B represents a copolymerizable ethylenically unsaturated monomer, Q represents N or P, $R_1^b$, $R_2^b$ and $R_3^b$ each represents an alkyl group or a cyclic hydrocarbon group or at least two of $R_1^b$ to $R_3^b$ are bonded together to form a ring (these groups and rings may be substituted), and M represents an anion.

(4) Copolymers composed of (a), (b) and (c), wherein (a) is

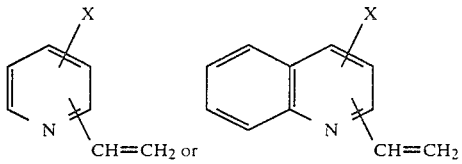

wherein X represents a hydrogen atom, an alkyl group or a halogen atom (the alkyl group may be substituted);

(b) is an acrylic ester; and (c) is acrylonitrile.

(5) Water-insoluble polymers wherein at least $\frac{1}{3}$ of the repeating units are those represented by the following general formula

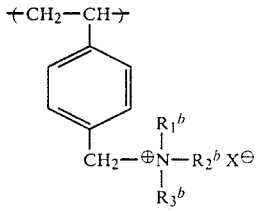

wherein $R_1^b$, $R_2^b$ and $R_3^b$ each represents an alkyl group, with the total number of carbon atoms included being 12 or more (the alkyl group may be substituted), and X represents an anion.

Various kinds of known gelatins can be employed as gelatin for the mordant layer. For example, gelatin which is produced in a different manner such as lime-processed gelatin, acid-processed gelatin, etc., or a gelatin derivative which is prepared by chemically modifying gelatin such as phthalated gelatin, sulfonylated gelatin, etc., can be used. Also, gelatin subjected to a desalting treatment can be used, if desired.

The ratio of polymer mordant to gelatin and the amount of the polymer mordant coated can be easily determined by one skilled in the art depending on the amount of the dye to be mordanted, the type and composition of the polymer mordant and further on the image-forming process used. Preferably, the ratio of mordant to gelatin is from 20/80 to 80/20 (by weight) and the amount of the mordant coated is from 0.5 to 8 g/m$^2$.

The dye fixing layer (II) can have a white reflective layer. For example, a layer of titanium dioxide dispersed in gelatin can be provided on the mordant layer on a transparent support. The layer of titanium dioxide forms a white opaque layer, by which reflection color images of the transferred color images which is observed through the transparent support is obtained.

Typical dye fixing material used in the present invention is obtained by mixing the polymer containing ammonium salt groups with gelatin and applying the mixture to a transparent support.

The transfer of dyes from the light-sensitive layer to the dye fixing layer can be carried out using a dye transfer assistant. Examples of useful dye transfer assistant include water and an alkaline aqueous solution containing sodium hydroxide, potassium hydroxide and an inorganic alkali metal salt. Further, a solvent having a low boiling point such as methanol, N,N-dimethylformamide, acetone, diisobutyl ketone, etc., and a mixture of such a solvent having a low boiling point with water or an alkaline aqueous solution can be used. The dye transfer assistant can be employed by wetting the image receiving layer with the transfer assistant or by incorporating it in the form of water of crystallization or microcapsules into the material.

The following examples are provided for illustrative purposes and are in no way intended to limit the scope of the present invention.

EXAMPLE 1

A silver iodobromide emulsion was made as follows.

In 3,000 ml of water, 40 g of gelatin and 26 g of KBr were dissolved. The resulting solution was kept at 50° C. and stirred. Thereto, a solution containing 34 g of silver nitrate dissolved in 200 ml of water was added dropwise over a 10 minute period. Thereafter, a solution containing 3.3 g of KI in 100 ml of water was further added. From the thus prepared silver iodobromide emulsion was removed excess salts by adjusting the pH of the emulsion to such a value as to cause sedimentation. Then, a pH of the emulsion was adjusted to 6.0. Thus, the intended silver iodobromide emulsion was obtained with a yield of 400 g.

On the other hand, a benzotriazolylsilver emulsion was prepared as follows.

In 3,000 ml of water, 28 g of gelatin and 13.2 g of benzotriazole were dissolved. The resulting solution was kept at 40° C. and stirred. Thereto, a solution containing 17 g of silver nitrate in 100 ml of water was added over a 2 minute period. From the thus prepared benzotriazolylsilver emulsion was removed excess salt by adjusting the pH of the emulsion to such a value as to cause sedimentation. Thereafter, a pH of the emulsion was adjusted to 6.0. Thus, the intended benzotriazolylsilver emulsion was obtained with a yield of 400 g.

Further, a gelatin dispersion of a dye-providing compound was prepared as follows.

The magenta Dye-Providing Compound (42) having the following formula,

Magenta Dye-Providing Compound (42):

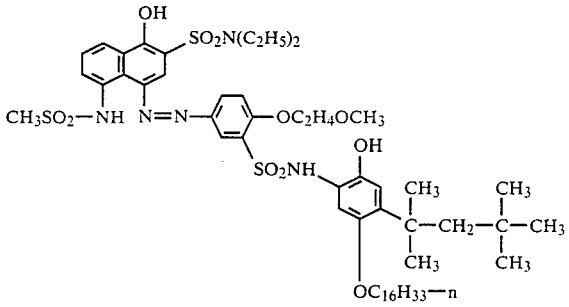

2-ethylhexyl sodium sulfosuccinate and tricresyl phosphate were weighed in amounts of 5 g, 0.5 g and 5 g, respectively. They were added to 30 ml of ethyl acetate and dissolved therein by heating to prepare a homogeneous solution. The solution was mixed with 100 g of a 10% solution of lime-processed gelatin with stirring and then dispersed thereinto by means of a homogenizer rotating at 10,000 rpm over a 10 minute period. The thus obtained dispersion was called the dispersion of the Dye-Providing Compound (42).

Next, Sensitive Material A was prepared in the following manner.

| Coating Composition for Light-Sensitive Layer: | |
|---|---|
| (a) The foregoing silver iodobromide emulsion | 25 g |
| (b) The dispersion of the Dye-Providing Compound (42) | 33 g |
| (c) 5% water solution of Compound AA | 5 ml |
| (d) 10% ethanol solution of guanidino-trichloroacetic acid | 12 ml |
| (e) 10% water solution of $H_2N—SO_2—N(CH_3)_2$ | 4 ml |

The foregoing (a) to (e) were mixed and dissolved to prepare the coating material. It was coated on a polyethylene terephthalate film support in a layer having a wet thickness of 30 μm, and dried. Further thereon, a solution obtained by mixing the following four kinds of solutions was coated as a protective layer with a wet thickness of 25 μm, and dried. Thus, the Sensitive Material A was obtained.

| Coating Composition for Protective Layer: | |
|---|---|
| (f) 10% water solution of gelatin | 35 g |
| (g) 10% ethanol solution of guanidino-trichloroacetic acid | 6 ml |
| (h) 1% water solution of 2-ethylhexyl sodium sulfosuccinate | 4 ml |
| (i) Water | 55 ml |

Further, Sensitive Material B was formed as follows.

| Coating Composition for Light-Sensitive Layer: | |
|---|---|
| (a) The foregoing benzotriazolylsilver emulsion | 10 g |
| (b) The foregoing silver iodobromide emulsion | 20 g |
| (c) The dispersion of the Dye-Providing Compound (7) | 33 g |
| (d) 5% water solution of Compound AA | 5 ml |
| (e) 10% ethanol solution of guanidino-trichloroacetic acid | 12.5 ml |
| (f) 10% methanol solution of 1-phenyl- | 10 ml |

-continued

| Coating Composition for Light-Sensitive Layer: | |
|---|---|
| 4,4-dimethyl-3-pyrazolidone | |

The dispersion of the Dye-Providing Compound (7) was prepared in the same manner as the dispersion of the Dye-Providing Compound (42) except for using Dye-Providing Compound (7) having the formula below in place of Dye-Providing Compound (42).

Dye-Providing Compound (7):

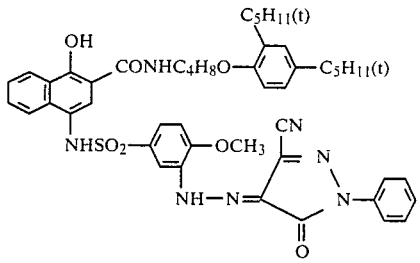

The above-described (a) to (f) were mixed and dissolved to prepare the coating material. It was coated on a polyethylene terephthalate film support in a layer having a wet thickness of 30 μm, and dried. Further thereon was provided the same protective layer as employed for the Sensitive Material A.

On the other hand, a dye-fixing material was prepared in the following manner.

In 200 ml of water, 10 g of poly(methylacrylate-co-N,N,N-trimethyl-N-vinylbenzylammonium chloride) (ratio of methylacrylate to vinylbenzylammonium chloride=1:1) was dissolved. The resulting solution was homogeneously mixed with 100 g of a 10% solution of lime-processed gelatin, and coated on a polyethylene terephthalate film, into which titanium dioxide had been dispersed, in a uniform layer having a wet thickness of 90μ.

On this coat, a coating composition obtained by admixing and dissolving the following amounts of ingredients (j) to (o) was uniformly coated in a layer having a wet thickness of 60 μm, and dried. The thus provided second layer is hereinafter called the hydrophilic thermal solvent layer.

(j) Urea (hydrophilic thermal solvent): 2 g
(k) N-Methylurea: 2 g
(l) Water: 8 ml
(m) 10 wt% aqueous solution of polyvinyl alcohol (saponification degree=98%): 12 g
(n) 5% water solution of Compound AA: 2 ml
(o) 5% water solution of sodium dodecylbenzenesulfonate: 0.5 ml After drying, the thus obtained material was used as the Dye-Fixing Material (A).

Dye-Fixing Material (B) was prepared in the same manner as employed for preparation of the Dye-Fixing Material (A) except that 0.3 g of tartaric acid was added to the above-described hydrophilic thermal solvent layer.

Structural Formula of Compound AA:

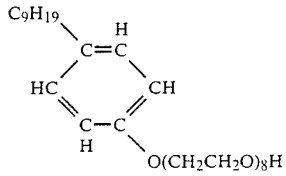

Each of the above-described Sensitive Materials A and B was exposed imagewise by means of a tungsten lamp with an illuminance of 2,000 lux for 10 minutes. Thereafter, they were uniformly heated for 20 seconds on a hot block heated to 140° C.

Next, the heated sensitive material described above and the dye-fixing material were superposed in such a state that the both coated layers were brought into face-to-face contact with each other. The thus superposed sample was passed through 140° C. hot rollers over a 40 second period and then the dye-fixing material was delaminated from the sensitive material. Thus, a magenta dye image positive to the silver image was formed on the dye-fixing material. The density of this negative image under exposure to green light was measured by means of a Macbeth reflection densitometer (RD 519), and the results obtained are set forth in the following table.

| Sensitive Material | Dye-Fixing Material | Maximum Density | Minimum Density | Remark |
|---|---|---|---|---|
| A | (A) | 2.21 | 0.56 | Comparison |
| A | (B) | 2.16 | 0.18 | Invention |
| B | (A) | 2.30 | 0.48 | Comparison |
| B | (B) | 2.28 | 0.15 | Invention |

The above-described results show that only samples relating to the present invention, wherein the Dye-Fixing Material (B) was used, exhibited low minimum densities and demonstrate the effectiveness of the present invention. It is also apparent from the table set forth above that the effect of the present invention was produced even when the organic silver salt was employed together. After the dye was completely transferred, the pH value of the light-sensitive layer in the Sensitive Material A was measured using the method described hereinbefore. The value was 8.2 where the combination with the Dye-Fixing material (A) was employed, while it was 6.3 where the combination with the Dye-Fixing Material (B) was employed.

EXAMPLE 2

Dye-fixing materials were produced in the same manner as Dye-Fixing Material (B) in Example 1 except that the acidic compounds set forth in the following table were used in place of tartaric acid, respectively. Each of them was used in combination with Sensitive Material A of Example 1, and received the same processings as described in Example 1.

The results obtained are as follows.

| Dye-Fixing Material | Acidic Compound | Amount Used (g) | Maximum Density | Minimum Density |
|---|---|---|---|---|
| (A) | None | — | 2.24 | 0.60 |
| (C) | Malic Acid | 0.2 | 2.22 | 0.14 |
| (D) | Glycolic Acid | 0.25 | 2.20 | 0.18 |

-continued

| Dye-Fixing Material | Acidic Compound | Amount Used (g) | Maximum Density | Minimum Density |
|---|---|---|---|---|
| (E) | Lactic Acid | 0.25 | 2.21 | 0.20 |
| (F) | Citric Acid | 0.25 | 2.20 | 0.16 |
| (G) | Ethylenediamine-tetraacetic Acid | 0.25 | 2.23 | 0.23 |
| (H) | Benzenesulfonic Acid | 0.25 | 2.21 | 0.16 |

The results set forth above show that the method of the present invention has a remarkable effect on the lowering of the minimum density.

EXAMPLE 3

Dye images were formed by carrying out the same experiment as in Example 1 except that the Dye-Providing Compounds set forth below, respectively, were employed in place of the Dye-Providing Compound (42) used in the Sensitive Material A of Example 1. The following results were obtained.

| Dye-Providing Compound | | Dye-Fixing Material | Maximum Density | Minimum Density |
|---|---|---|---|---|
| (10) | 5 g | (A) | 2.25 | 0.60 |
| | | (B) | 2.22 | 0.19 |
| (68) | 7.5 g | (A) | 1.99 | 0.42 |
| | | (B) | 1.95 | 0.15 |
| (21) | 5 g | (A) | 2.40 | 0.69 |
| | | (B) | 2.33 | 0.20 |

As can be seen from the above table, the effect of the present invention was produced irrespective of the kind of the dye-providing compound used.

Dye-Providing Compound (10):

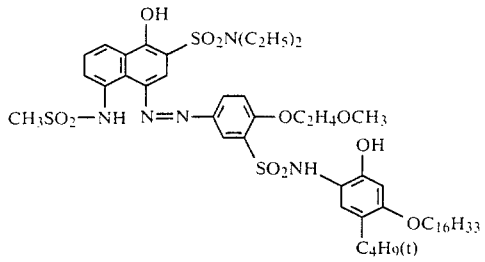

Dye-Providing Compound (21):

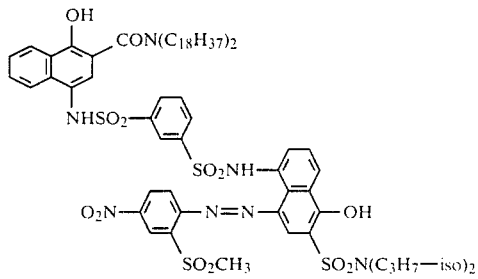

Dye-Providing Compound (68):

-continued

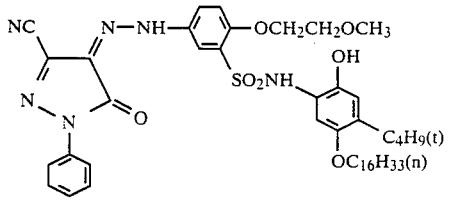

EXAMPLE 4

A gelatin dispersion of Dye-Providing Compound BB to be employed in the reaction (1) was prepared in the following manner.

10 g of magenta Dye-Providing Compound BB, 0.5 g of 2-ethylhexyl sodium sulfosuccinate and 10 g of tricresyl phosphate were weighed out, and added to 20 ml of cyclohexanone. The resulting mixture was heated to about 60° C. for dissolution to prepare a homogeneous solution. This solution was admixed with 100 g of a 10% solution of lime-processed gelatin with stirring, and further dispersed thereinto by means of a homogenizer rotating at 10,000 rpm over a 10 minute period. The thus obtained dispersion was called the dispersion of Dye-Providing Compound (BB).

Sensitive Material C was produced in the following manner.

(a) Same benzotriazolylsilver emulsion as prepared in Example 1: 5 g
(b) Same silver iodobromide emulsion as prepared in Example 1: 2 g
(c) 10% water solution of gelatin: 2 g
(d) Dispersion of Dye-Providing Compound (BB): 2.5 g
(e) 10% ethanol solution of guanidinotrichloroacetic acid: 0.5 ml
(f) 10% methanol solution of 2,6-dichloroaminophenol: 0.5 ml
(g) 5% water solution of Compound AA: 1 ml
(h) Water: 4.5 ml The above-described (a) to (h) were mixed and dissolved, and coated on a polyethylene terephthalate film in a layer having a wet thickness of 85μ. After drying the coat, the same coating composition as employed for forming the protective layer in Example 1 was applied to the coat in the same manner as in Example 1.

Using the thus obtained Sensitive Material C and the same dye-fixing materials as used in Example 1, the same processings and measurements was in Example 1 were carried out.

The results obtained are shown below.

| Sensitive Material | Dye-Fixing Material | Maximum Density | Minimum Density |
|---|---|---|---|
| C | (A) | 2.11 | 0.62 |
| C | (B) | 2.18 | 0.13 |

It is apparent from the above table that the effect of the present invention was also produced in reaction (1)wherein the compound releasing the mobile dye was involved.

Dye-Providing Compound BB:

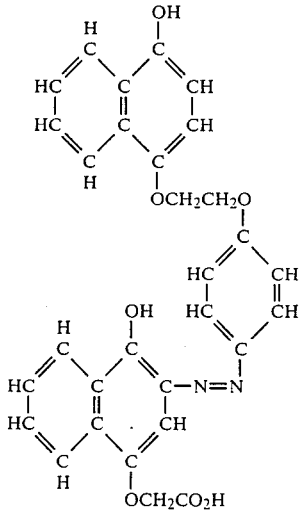

EXAMPLE 5

A 10% water solution of acrylic acid polymer was coated on a 120 μm thick polyethylene terephthalate film into which titanium oxide had been dispersed, in a layer having a wet thickness of 50 μm, and dried. Thereon, a solution prepared by dissolving 10 g of poly(methylacrylate-co-N,N,N-trimethyl-N-vinylbenzylammonium chloride) (ratio of methylacrylate to vinylbenzylammonium chloride=1:1) in 200 ml of water was homogeneously mixed with 100 g of a 10% lime-processed gelatin solution and coated in a layer having a wet thickness of 90 μm, and dried. Further, thereon was provided the same hydrophilic thermal solvent layer as used in Dye-Fixing Material (A). The thus produced material was called Dye-Fixing Material (C).

Using Sensitive Material A, Dye-Fixing Material (A) and Dye-Fixing Material (C), the same experiments as in Example 1 were carried out. The results obtained are as follows.

| Sensitive Material | Dye-Fixing Material | Maximum Density | Minimum Density |
|---|---|---|---|
| A | (A) | 2.26 | 0.58 |
| A | (C) | 2.24 | 0.28 |

As can be seen from the above table, the effect of the present invention was produced also where the non-diffusible acidic polymer was used in the dye-fixing material.

EXAMPLE 6

100 g of a 10% water solution of poly(methylacrylate-co-N,N,N-trimethyl-N-vinylbenzylammonium chloride) (ratio of methylacrylate to vinylbenzylammonium chloride=1:1), 120 g of a 10% water solution of polyvinyl alcohol (saponification degree=98%, polymerization degree=2,000), 40 g of urea, 0.4 g of dimethylolurea and 2 ml of malic acid were mixed homogeneously. The resulting mixture was coated in a layer having a wet thickness of 90 μm, and dried to make Dye-Fixing Material (D). Another Dye-Fixing Material (E) was formed in the same manner as described above except that malic acid was removed from Dye-Fixing Material (D). Using the thus produced dye-fixing material in combination with Sensitive Material B, the same experiments as in Example 1 were carried out. The results obtained are shown below.

| Sensitive Material | Dye-Fixing Material | Maximum Density | Minimum Density |
|---|---|---|---|
| B | (D) | 2.35 | 0.15 |
| B | (E) | 2.33 | 0.63 |

The data set forth above show that the present invention had the intended effect where the hydrophilic thermal solvent was added to the dye-fixing layer of the dye-fixing material.

While the invention has been described in detail and with reference to specific embodiments thereof, it will be apparent to one skilled in the art that various changes and modifications can be made therein without departing from the spirit and scope thereof.

What is claimed is:

1. A method of forming an image comprising (A) imagewise exposing a light-sensitive material having on a support at least (1) a light-sensitive silver halide, (2) a binder, and (3) a compound which is chemically involved in the reduction of the light-sensitive silver halide to silver under high temperature thereby causing the production or the release of a mobile dye, (B) heating the light-sensitive material in a substantially water-free condition to form the mobile dye with an imagewise distribution subsequently to or simultaneously with the imagewise exposure and then, (C) transferring the mobile dye formed into a dye-fixing layer under high temperature and fixing it thereto; wherein an acidic component participates chemically in the reaction system for forming said mobile dye after the conclusion of the mobile dye-forming reaction, wherein said high temperature is not less than 80° C. and wherein said acidic component is present in an amount sufficient to adjust the pH value to in the range of below 8.5.

2. The process as claimed in claim 1, wherein said acidic compound is selected from the group consisting of aliphatic saturated monocarboxylic acids, aliphatic unsaturated monocarboxylic acids, aliphatic or aromatic polycarboxylic acids, aromatic monocarboxylic acids, organic acids having an acidic hydroxyl group, aliphatic or aromatic sulfonic acids, amino acids and their derivatives, nucleic acids and their derivatives, heterocyclic compounds which have an apparent acid dissociation constant of 9 or less and inorganic nonvolatile acids.

3. The process as claimed in claim 1, wherein said acidic component is present in an amount sufficient to adjust a pH value in a range of from 3 to 7.

4. The process as claimed in claim 1, wherein said acidic component is a diffusible acid having a molecular weight of 300 or less and having an inorganicity/organicity value of 1 or more.

5. The process as claimed in claim 4, wherein said diffusible acidic compound is associated with said dye-fixing layer.

6. The process as claimed in claim 1, wherein there is further present an organic silver salt oxidizing agent.

7. A method of forming an image comprising (A) imagewise exposing a light-sensitive material having on a support at least (1) a light-sensitive silver halide, (2) a binder, and (3) a compound which is chemically involved in the reduction of the light-sensitive silver halide to silver under high temperature thereby causing the production or the release of a mobile dye, (B) heating the light-sensitive material in a substantially water-free condition to form the mobile dye with an imagewise distribution subsequently to or simultaneously with the imagewise exposure and then, (C) transferring the mobile dye formed into a dye-fixing layer under high temperature and fixing it thereto; wherein an acidic component participates chemically in the reaction system for forming said mobile dye after the conclusion of the mobile dye-forming reaction, wherein said high temperature is not less than 80° C., wherein said acidic component is present in an amount sufficient to adjust the pH value to in the range of below 8.5, further wherein step (C) is conducted in the presence of a hydrophilic thermal solvent.

8. The process as claimed in claim 7, wherein said hydrophilic thermal solvent is a compound which is transformed into liquid by heating though it is in a solid state at ordinary temperatures, has an (inorganicity/organicity) value of 1 or above, and has a solubility of 1 or more in water at ordinary temperatures.

9. The process as claimed in claim 8, wherein said hydrophilic thermal solvent is used in at least one of the sensitive material and the dye-fixing material, in a coverage corresponding to 5 to 500 wt% of the total coverage of the sensitive material and/or the dye-fixing material other than the coverage of the hydrophilic thermal solvent therein.

10. The process as claimed in claim 8, wherein the hydrophilic thermal solvent is selected from the group consisting of ureas, pyridines, amides, sulfonamides, imides, alcohols, and oximes.

11. The process as claimed in claim 7, wherein said acidic component is a diffusible acid having a molecular weight of 300 or less and having an inorganicity/organicity value of 1 or more.

12. The process as claimed in claim 11, wherein said diffusible acidic compound is associated with said dye-fixing layer.

13. The process as claimed in claim 7, wherein there is further present an organic silver salt oxidizing agent.

* * * * *